US008837968B2

(12) United States Patent
Andoh et al.

(10) Patent No.: US 8,837,968 B2
(45) Date of Patent: Sep. 16, 2014

(54) IMAGE FORMATION APPARATUS, DRIVING CONTROL METHOD, AND COMPUTER PROGRAM PRODUCT

(75) Inventors: Toshiyuki Andoh, Kanagawa (JP); Takashi Hashimoto, Kanagawa (JP); Takashi Hodoshima, Kanagawa (JP); Masahiko Kato, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 214 days.

(21) Appl. No.: 13/302,296

(22) Filed: Nov. 22, 2011

(65) Prior Publication Data

US 2012/0163846 A1 Jun. 28, 2012

(30) Foreign Application Priority Data

Nov. 30, 2010 (JP) ..... 2010-266095

(51) Int. Cl.
*G03G 15/16* (2006.01)
*G03G 15/00* (2006.01)
*G03G 15/01* (2006.01)

(52) U.S. Cl.
CPC ..... *G03G 15/1615* (2013.01); *G03G 15/5054* (2013.01); *G03G 2215/00156* (2013.01); *G03G 15/6564* (2013.01); *G03G 15/0189* (2013.01); *G03G 2215/00059* (2013.01); *G03G 15/0131* (2013.01); *G03G 15/5008* (2013.01); *G03G 2215/00599* (2013.01); *G03G 2215/00075* (2013.01)
USPC ..... 399/66; 399/302; 399/308

(58) Field of Classification Search
CPC ..... G03G 15/161; G03G 15/1615; G03G 15/5054; G03G 2215/00156
USPC ..... 399/66, 313
See application file for complete search history.

(56) References Cited

U.S. PATENT DOCUMENTS 5,729,111 A * 3/1998 Ogura et al. ..... 318/623
6,584,295 B2 * 6/2003 Omata et al. ..... 399/306
(Continued)

FOREIGN PATENT DOCUMENTS

JP 02053083 A 2/1990
JP 3528342 B2 1/1997
(Continued)

OTHER PUBLICATIONS

Abstract of JP 02-053083 published Feb. 22, 1990.
(Continued)

*Primary Examiner* — Benjamin Schmitt
(74) *Attorney, Agent, or Firm* — Harness, Dickey & Pierce, P.L.C.

(57) ABSTRACT

An image formation apparatus includes an image carrier; a driving source generating a driving force for the image carrier; a drive transmission unit; a driving control unit controlling the driving source; an image formation unit forming an image on a surface of the image carrier; a transfer nip between a transfer member and the surface of the image carrier; a driving-force exerting unit exerting a driving force on any one of the image carrier and a first drive transmission member on a drive transmission path, and a specific drive transmission member imparting weakest spring characteristics among drive transmission members to a drive transmission system; a detecting unit detecting an estimation parameter used in estimating a driving-load-torque variation amount of the image carrier; a torque-variation-amount estimation unit; and a driving-force control unit controlling the driving force to cancel the driving-load-torque variation.

10 Claims, 13 Drawing Sheets

(56) References Cited

U.S. PATENT DOCUMENTS

| | | | | |
|---|---|---|---|---|
| 2005/0105937 | A1* | 5/2005 | Sakai | 399/301 |
| 2007/0025768 | A1* | 2/2007 | Komatsu et al. | 399/167 |
| 2008/0107435 | A1* | 5/2008 | Scherdel et al. | 399/66 |
| 2008/0175612 | A1* | 7/2008 | Oikawa et al. | 399/66 |

FOREIGN PATENT DOCUMENTS

| | | | |
|---|---|---|---|
| JP | 2005227509 | A | 8/2005 |
| JP | 2006085153 | A | 3/2006 |
| JP | 2011133883 | A | 7/2011 |

OTHER PUBLICATIONS

Abstract of JP 2006-085153 published Mar. 30, 2006.
Abstract of JP 09-026711 published Jan. 28, 1997.
Abstract of JP 2005-227509 published Aug. 25, 2005.
Abstract of JP 2011-133883 published Jul. 7, 2011.

* cited by examiner

IMAGE FORMATION APPARATUS, DRIVING CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2010-266095 filed in Japan on Nov. 30, 2010. The present document incorporates by reference the entire contents of Japanese application, 2009-272023 filed in Japan on Nov. 30, 2009.

BACKGROUND OF THE INVENTION

1. Field of the Invention

The present invention relates to an image formation apparatus, such as a copying machine, a printer, or a facsimile, that forms an image by electrophotography, electrostatography, iconography, magnetic recording method, or the like as well as to a driving control method for an image carrier and a computer program product that stores therein a computer program for executing the driving control method.

2. Description of the Related Art

As an image formation apparatus of this type, an image formation apparatus having a transfer nip is widely known. In the apparatus, the transfer nip is formed by an image carrier, such as a photosensitive element or an intermediate transfer member, and a transfer member, and a visible image formed on the image carrier is transferred onto a recording medium such as a sheet. In such an image formation apparatus, an impact that occurs when the recording medium enters the transfer nip momentarily causes, to the image carrier, a large load torque that causes a change in the surface moving velocity of the image carrier to result in image degradation.

Japanese Patent No. 3528342 and Japanese Patent Application Laid-open No. H2-53083 disclose the technology that can reduce the image degradation caused by an impact that occurs when a recording medium enters the transfer nip in the image formation apparatuses.

An image formation, apparatus disclosed in Japanese Patent No. 3528342 or that disclosed in Japanese Patent Application Laid-open No. H2-53083 includes a braking device that exerts a braking force on a driving source of an image carrier. The braking device exerts a braking force (driving load torque) corresponding to a load that is to be applied when a recording medium enters the transfer nip to the image carrier in advance before the recording medium enters a transfer nip. The image formation apparatus also measures a torque change on the image carrier that occurs when a recording medium enters the transfer nip in advance by an experiment, a computer simulation, or the like, and holds the thus-obtained torque variation profile (waveform of the torque variation). And then, by adjusting to the timing when the recording medium enters the transfer nip, the braking force provided by the braking device can be reduced or removed in accordance with the torque variation profile, thereby reducing the variation in the surface moving velocity of the image carrier.

However, there has been a problem in the conventional image formation apparatus that exerts a braking force (driving load torque) on the driving source in advance and reduces or removes the braking force when a recording medium is going to enter the transfer nip so as to suppress a variation in the surface moving velocity of the image carrier, as described below.

It has conventionally been considered that a torque variation profile of the image carrier occurring when a recording medium enters the transfer nip can be treated as essentially the same between different recording media so long as the recording media are similar to each other (e.g., the recording media having a same thickness). Therefore, as described above, the conventional image formation apparatus typically obtains by prior measurement for each type of the recording media, on which images are to be formed, a profile of a torque variation that occurs when the recording medium enters the transfer nip, and controls the braking device so as to cancel the torque variation based on the torque variation profile at a timing when the recording medium enters the transfer nip. Even with such control, a torque variation on the image carrier occurring when a recording medium enters the transfer nip can be cancelled with high accuracy in a case where the image formation is performed in the same condition as that used in the measurement of the torque variation profile and where the image formation is performed to the same kind of recording medium as that used in the measurement.

In practice, however, a type of a recording medium to be used depends on a user of the image formation apparatus. Furthermore, an environment or a condition, in which image formation is to be performed, also depends on the user of the image formation apparatus. For these reasons, in many cases, an actual torque variation profile occurring when the recording medium enters the transfer nip does not match the torque variation profile obtained by the prior measurement. In particular, the torque variation profile occurring when the recording medium enters the transfer nip can change due to various types of factors even when the recording media are identical to each other in thickness and material properties. Examples of the factors include a difference in humidity, a difference in degrees of skew or curl of the recording media in entering the transfer nip, a difference in the direction of fibers forming the recording media, and a difference in the lengths of the recording media in a recording-medium conveying direction. Accordingly, it is impracticable to prepare every torque variation profile that is anticipated to occur in an actual image formation process. Even if every torque variation profile that is anticipated to occur in the actual image formation process can be prepared, it is considerably difficult to select a profile optimum to each image formation process from the thus-prepared large number of torque variation profiles.

As described above, the conventional image formation apparatus that tries to cancel a torque variation in the driving source occurring when a recording medium enters the transfer nip on the basis of the torque variation profile prepared in advance cannot cope with all the actual torque variation profiles that vary from one image formation process to another depending on the various kinds of factors. Thus, in many cases, the conventional image formation apparatus is unable to cancel the torque variation of the image carrier with sufficient accuracy or to suppress a variation in the surface moving velocity of the image carrier.

Furthermore, for the conventional image formation apparatus, in order to cancel the torque variation of the image carrier by braking control based on the torque variation profile obtained in advance, it is necessary to cause a phase of the torque variation profile obtained by a prior measurement to coincide with an actual torque variation profile occurring when a recording medium enters the transfer nip. In order to achieve this coincidence, it is necessary to detect, with high accuracy, the timing when the recording medium actually enters the transfer nip. The timing when the recording medium actually enters the transfer nip varies from one image formation process to another even when the recording media are of a same type. Accordingly, the timing when the recording medium actually enters the transfer nip is typically determined by using a sensor. Meanwhile, it is difficult to directly detect the position of a leading-end of the recording medium that enters the transfer nip. Therefore, in general, detection is made with the sensor on the position of the leading-end of the recording medium a certain period of time before the recording medium enters the transfer nip. Accordingly, if a conveying velocity of the recording medium differs from a target conveying velocity, an error occurs in the timing, determined by the detection result with the sensor, for the recording medium to enter the transfer nip. A detection error of the sensor or an assembly error of the sensor also causes an error in the timing for the recording medium to enter the transfer nip according to the determination by the detection result with the sensor. Such an error makes it difficult to detect the timing when the recording medium enters the transfer nip with high accuracy. Therefore, in many cases, the conventional image formation apparatus, for which it is necessary to detect timing when a recording medium enters the transfer nip, fails to cancel the torque variation of the image carrier with sufficiently high accuracy, and hence cannot reduce the variation in the surface moving velocity of the image carrier.

A control method, which is typically employed in a conventional image formation apparatus, of obtaining a torque variation profile by a prior measurement and performing braking control based on the torque variation profile so as to cancel torque variation of an image carrier is primarily incapable of canceling torque variation of an image carrier caused by an impact whose occurrence is unpredictable or unable to be predicted with high accuracy. Even for an impact whose occurrence is predictable with high accuracy, if a profile of torque variation in the image carrier caused by the impact is irregular, the torque variation cannot be cancelled with high accuracy.

Furthermore, in the control method, that is typically adopted in the conventional image formation apparatuses, of canceling torque variation of an image carrier by braking control, it is necessary to exert a braking force (driving load torque) on the image carrier during when the impact is not applied to the image carrier. However, according to such a control method, it is necessary to apply an additional driving torque that corresponds to a driving load torque to be caused by an impact during when the impact is not applied to the image carrier. Accordingly, this control method, requiring a driving source of an image carrier to generate the additional driving torque, is disadvantageous in increasing power consumption.

This control method also requires that the magnitude of the braking force (driving load torque) to be exerted on the image carrier in advance be set to have a greater value than a driving load torque caused by a real impact. Accordingly, the control method is also disadvantageous in that it is necessary to determine, in advance, a driving load torque to be caused by a real impact.

SUMMARY OF THE INVENTION

It is an object of the present invention to at least partially solve the problems in the conventional technology.

According to an aspect of the present invention, there is provided an image formation apparatus for forming an image on a recording medium, the image formation apparatus including: an image carrier; a driving source that generates a driving force for driving the image carrier; a drive transmission unit that transmits the driving force generated by the driving source to the image carrier; a driving control unit that controls the driving source to cause the image carrier to be driven at any one of a target driving angular velocity and a target velocity; an image formation unit that forms an image on a surface of the image carrier, the surface being moved by the driving force transmitted from the drive transmission unit; a transfer member that forms, between the transfer member and the surface of the image carrier, a transfer nip, which the recording medium enters to transfer the image formed on the surface of the image carrier onto the recording medium; a driving-force exerting unit that exerts a driving force on any one of the image carrier and a first drive transmission member among transmission members provided on a drive transmission path ranging from the driving source to the image carrier, the first drive transmission member being on a side of the image carrier with reference to a specific drive transmission member, and the specific drive transmission member imparting weakest spring characteristics among the drive transmission members to a drive transmission system formed by the drive transmission members; a detecting unit that detects an estimation parameter used in estimating a driving-load-torque variation amount of the image carrier; a torque-variation-amount estimation unit that, samples estimation parameters detected by the detecting unit continually at a predetermined sampling interval and estimates the driving-load-torque variation amount based on the sampled estimation parameters; and a driving-force control unit that controls the driving force to be exerted by the driving-force exerting unit to cause the driving force to cancel the driving-load-torque variation amount estimated by the torque-variation-amount estimation unit.

According to another aspect of the present invention, there is provided a driving control method for an image carrier of an image formation apparatus that forms an image on a recording medium, the image formation apparatus including: the image carrier; a driving source that generates a driving force for driving the image carrier; a drive transmission unit that transmits the driving force generated by the driving source to the image carrier; a driving control unit that controls a driving angular velocity of the driving source so as to cause the image carrier to be driven at any one of a target driving angular velocity and a target velocity; an image formation unit that forms an image on a surface of the image carrier, the surface being moved by the driving force transmitted from the drive transmission unit; and a transfer member that forms, between the transfer member and the surface of the image carrier, a transfer nip, which the recording medium enters to transfer the image formed on the surface of the image carrier onto the recording medium, the driving control method including: detecting an estimation parameter for use in estimating a driving-load-torque variation amount of the image carrier; sampling detected estimation parameters continually at a predetermined sampling interval; estimating the driving-load-torque variation amount based on the sampled estimation parameters; and exerting a driving force on any one of the image carrier and a first drive transmission member among transmission members provided on a drive transmission path ranging from the driving source to the image carrier, the first drive transmission member being on a side of the image carrier with reference to a specific drive transmission member, and the specific drive transmission member imparting weakest spring characteristics among the drive transmission members to a drive transmission system formed by the drive transmission members so as to cancel the estimated driving-load-torque variation amount.

According to still another aspect of the present invention, there is provided a computer program product stored in a readable storage medium that stores therein program instructions, which when executed by a computer of an image formation apparatus that forms an image on a recording medium, the image formation apparatus including: an image carrier; a driving source that generates a driving force for driving the image carrier; a drive transmission unit that transmits the driving force generated by the driving source to the image carrier; a driving control unit that controls a driving angular velocity of the driving source so as to cause the image carrier to be driven at any one of a target driving angular velocity and a target velocity; an image formation unit that forms an image on a surface of the image carrier, the surface being moved by the driving force transmitted from the drive transmission unit; a transfer member that forms, between the transfer member and the surface of the image carrier, a transfer nip, which the recording medium enters to transfer the image formed on the surface of the image carrier onto the recording medium; and a driving-force exerting unit that exerts a driving force on any one of the image carrier and a first drive transmission member among transmission members provided on a drive transmission path ranging from the driving source to the image carrier, the first drive transmission member being on a side of the image carrier with reference to a specific drive transmission member, and the specific drive transmission member imparting weakest spring characteristics among the drive transmission members to a drive transmission system of drive transmission members, the program instructions instructing the computer to function as: a torque-variation-amount estimation unit that samples estimation parameters for use in estimating a driving-load-torque variation amount of the image carrier and estimates the driving-load-torque variation amount based on the sampled estimation parameters; and a driving-force control unit that controls the driving force to be exerted by the driving-force exerting unit so as to cause the driving force to cancel the driving-load-torque variation amount estimated by the torque-variation-amount estimation unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

An embodiment (hereinafter, the present embodiment is referred to as a "first embodiment"), in which the present invention is applied to a copying machine serving as an image formation apparatus, will be described below.

Figure 2:
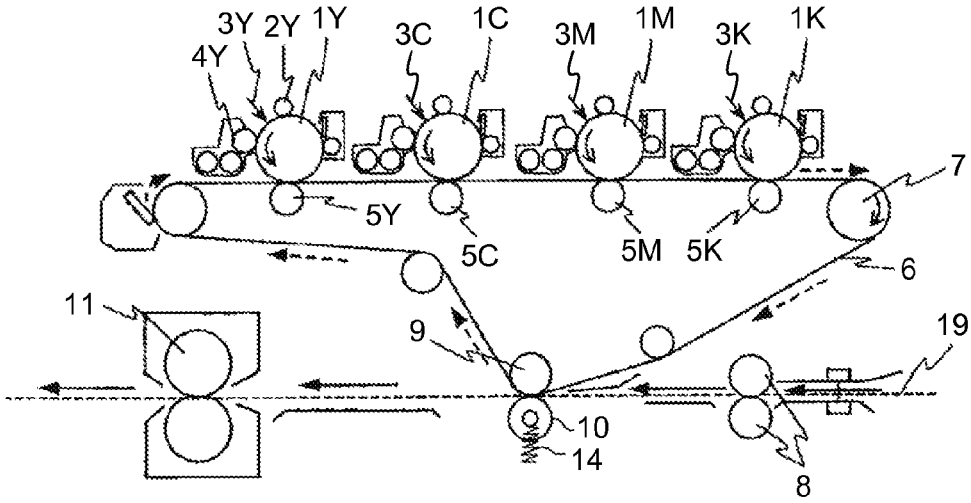
FIG. 2 is a schematic configuration diagram illustrating an image formation unit of the printer.

FIG. 2 is a schematic configuration diagram illustrating an image formation unit of the copying machine according to the first embodiment. The copying machine is a tandem type image formation apparatus that includes a photosensitive element as an image carrier for each of colors including yellow (Y), cyan (C), magenta (M), and black (K). In FIG. 2, one of Y, C, M, and K, each of which is a color-distinguishing symbol to indicate a color of a member, is added to a reference symbol that is assigned to the member with the corresponding color; however, members different in colors have a substantially identical configuration to each other. Accordingly, the color-distinguishing symbols are omitted from the reference symbols in the explanations below.

A photosensitive element 1 is electrostatically charged by a charging unit 2 to have a uniform surface potential. An exposing unit divides the surface of the photosensitive element 1 into an image portion and a non-image portion based on information about an image to be formed and performs writing exposure 3, thereby forming an electrostatic latent image on the surface. A developing unit 4 performs development that causes toner to stick onto the image portion of the electrostatic latent image on the surface of the photosensitive element 1, so that a toner image (image) is formed thereon. The toner image is thereafter transferred onto an intermediate transfer belt 6, serving as the image carrier, by an action of bias applied, onto a primary transfer roller 5 in a primary transfer unit.

The photosensitive elements 1 are aligned on a surface-moving path of the intermediate transfer belt 6 to be in contact with the intermediate transfer belt 6. The toner images formed on the photosensitive elements 1 are transferred, in each of the primary transfer units, sequentially onto a same position on the intermediate transfer belt 6. The intermediate transfer belt 6 is stretched around a plurality of rollers including a driving roller 7 and rotated. The driving roller 7 is rotated by a driving motor, which is a driving source to be described later.

The full color toner image formed on the intermediate transfer belt 6 is transferred in a secondary transfer unit onto a transfer sheet, which is a recording medium, conveyed along a feed path 19 in a direction indicated by solid arrows illustrated in FIG. 2. The transfer sheet conveyed from a paper feeding device of the image formation apparatus passes through a pair of registration rollers 8 that adjusts a position of a leading end of the transfer sheet and conveys the transfer sheet to the secondary transfer unit. In the secondary transfer unit, a transfer nip is formed between a secondary transfer roller 10 arranged on an external side of the intermediate transfer belt 6 and a secondary-transfer opposed roller 9 arranged inside the intermediate transfer belt 6. An electric field is created in the transfer nip to transfer the toner image onto the transfer sheet. A shaft of the secondary transfer roller 10 receives pressure from a pressing spring 14, and hence the secondary transfer roller 10 is urged to press the secondary-transfer opposed roller 9. The secondary transfer roller 10 is pressed toward the intermediate transfer belt 6 and rotates in contact with the intermediate transfer belt 6 or the transfer sheet. The transfer sheet, onto which the toner image is transferred, passes through a fixing unit 11 that applies heat and pressure to the transfer sheet. The toner image is thus fixed onto the transfer sheet.

In the image formation process described above, driving the photosensitive element 1 and the intermediate transfer belt 6 at a constant velocity is a key factor. If the velocity of the photosensitive element 1 varies, even when the variation in the velocity is minute, a portion of an image that has to be uniform in image density becomes non-uniform. Even when the velocity of the photosensitive element 1 is kept constant, if the velocity of the intermediate transfer belt 6 varies, there arises a difference in the velocities between the intermediate transfer belt 6 and the photosensitive element 1 to cause, undesirably, the image to be elongated or shortened or the image density to be non-uniform. In particular, when a momentary load is imposed on the intermediate transfer belt 6 by an impact that occurs when a leading end of a transfer sheet enters the transfer nip of the secondary transfer unit, and hence variation in the velocity of the intermediate transfer belt 6 occurs, image quality degrades considerably. A method for reducing degradation in image quality caused by an impact that occurs when a leading end of a transfer sheet enters the transfer nip of the secondary transfer unit will be described below.

Figure 3:
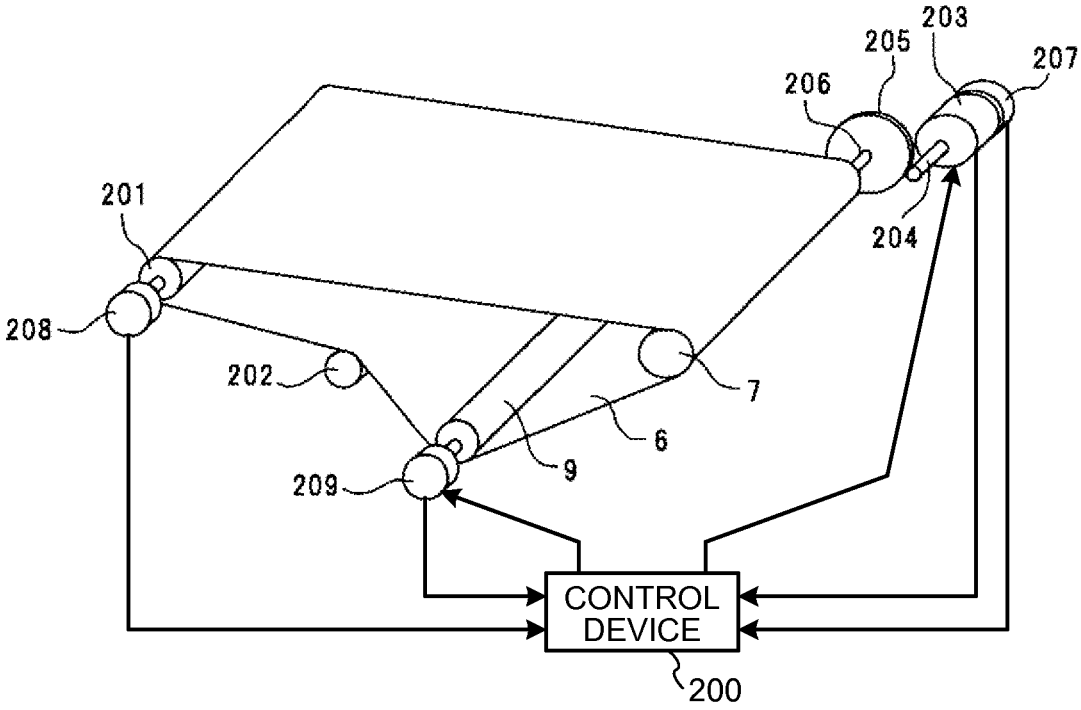
FIG. 3 is an explanatory diagram according to the first embodiment illustrating a configuration related to driving control of the intermediate transfer belt of the printer.

FIG. 3 is an explanatory diagram illustrating the configuration related to driving control of the intermediate transfer belt 6 according to the first embodiment.

In the first embodiment, a control device 200 controls a direct current (DC) motor 203, which is the driving source, and an auxiliary motor 209, which is a braking unit, so as to rotate the intermediate transfer belt 6, which is the image carrier formed by an endless belt stretched by and wound around the driving roller 7 and driven rollers 9, 201, and 202, at a constant velocity. As illustrated in FIG. 3, the driving roller 7 and the driven rollers 9 and 201 have a same diameter. A running torque (driving force) of the DC motor 203 is transmitted via a gear reducer mechanism including two gears 204 and 205 to a rotary shaft 206 of the driving roller 7. The driving roller 7 is thus rotated, causing the surface movement of the intermediate transfer belt 6. Feedback control (constant-speed control of a motor) of the DC motor 203 is performed by the control device 200, corresponding to a driving control unit, based on an output of a motor-angular-velocity detecting encoder 207 provided on an output shaft of the DC motor.

A driven-roller-angular-velocity detecting encoder 208 is attached via a coupling (not shown) to a rotary shaft of the driven roller 201 that supports the intermediate transfer belt 6.

The auxiliary motor 209, corresponding to the braking unit, is attached with a joint (not shown) having great rigidity to the secondary-transfer opposed roller 9, which is another driven roller of the intermediate transfer belt 6. The control, device 200 can control the magnitude of a driving force to be exerted by the auxiliary motor 209 on the secondary-transfer opposed roller 9. As the auxiliary motor 209, for example, a DC motor that can apply a driving torque in a direction accelerating rotation of the secondary-transfer opposed roller 9 and a load torque in a direction decelerating the rotation by, for example, changing a running speed of the auxiliary motor 209 by controlling a driving current with an electric-current controller can be used.

Note that any device can be used as the auxiliary motor 209 if the device can exert a driving force (driving torque) on the intermediate transfer belt 6 and the magnitude of the driving force is adjustable by the control device 200 in a multistep manner.

The auxiliary motor 209 is to exert the driving force on a drive transmission member or directly on the intermediate transfer belt 6. The drive transmission member is provided on the downstream (on a side of the intermediate transfer belt 6) of the gear reducer mechanism 204 and 205, serving as specific drive transmission members, on a drive transmission path. The gear reducer mechanism 204, 205 provides weakest spring characteristics, which is the spring characteristics having the greatest effect on a drive transmission system of drive transmission members among the drive transmission members provided on the drive transmission path. Accordingly, the auxiliary motor 209 is not necessarily provided on the secondary-transfer opposed roller 9 but can be provided on one of other support rollers 7, 201, and 202 supporting the intermediate transfer belt 6. The auxiliary motor 209 can alternatively exert the driving force on the intermediate transfer belt 6 via another member that is in contact with an outer peripheral surface or an inner peripheral surface of the intermediate transfer belt 6. Note that the closer a location, to which the driving force is applied by the auxiliary motor 209, to the secondary transfer unit at which an impact occurs when the transfer sheet enters the transfer nip, the more effectively the variation in torque of the intermediate transfer belt 6 caused by the impact can be cancelled. Accordingly, it is preferable for the driving control of the intermediate transfer belt 6 to be configured, as in the first embodiment, to exert the driving force on the intermediate transfer belt 6 via the secondary-transfer opposed roller 9.

Figure 4:
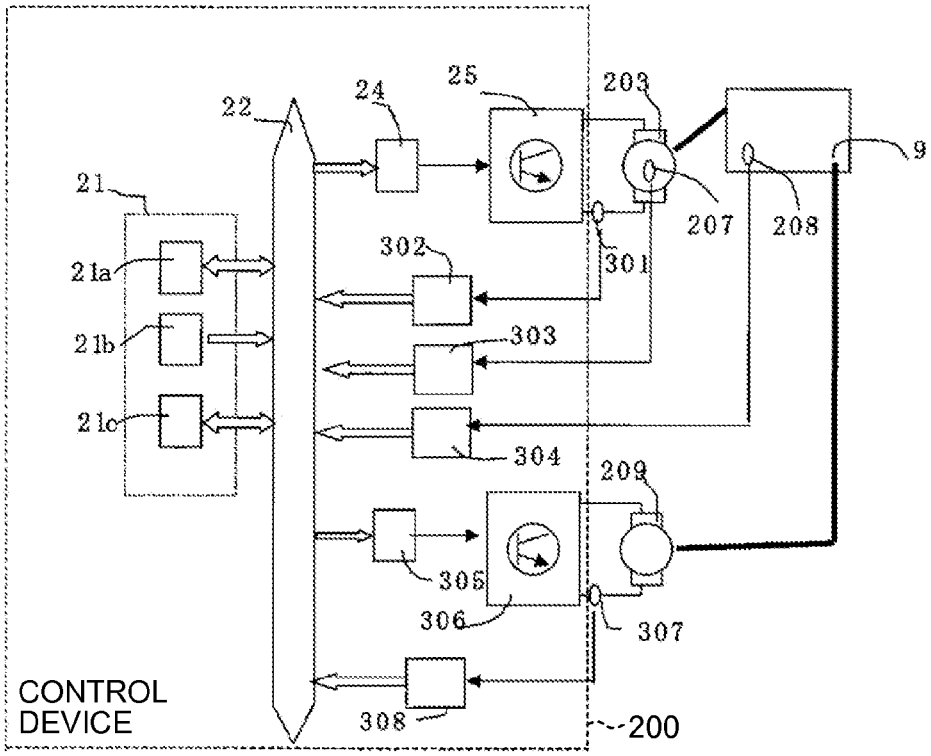
FIG. 4 is a hardware block diagram for explaining a drive control system of the intermediate transfer belt formed by the control device of the printer according to the first embodiment.

FIG. 4 is a hardware block diagram for explaining a drive control system for the intermediate transfer belt 6 controlled by the control device 200 according to the first embodiment.

The drive control system for the intermediate transfer belt 6 according to the first embodiment is roughly divided into two feedback control systems. A first feedback control system is a motor constant-speed control system that performs feedback control of the angular velocity (hereinafter, "motor angular velocity") of the DC motor 203, which is the driving source of the intermediate transfer belt 6, based on an output signal of the motor-angular-velocity detecting encoder 207. A second feedback control system is a torque-exertion control system, in which an external disturbance estimator, which will be described later, serving as a torque-variation-amount estimation unit, estimates a variation amount of the load torque applied to the intermediate transfer belt 6 by using estimation parameters and an analytical model, which will be described later. The estimation parameters include a driving current (driving input value) of the DC motor 203, a motor angular velocity, and an angular velocity of a driven roller (hereinafter, "driven-roller angular velocity") of the intermediate transfer belt 6. The second feedback control system performs feedback control of the auxiliary motor 209 based on a result of the estimation.

The drive control system for the intermediate transfer belt 6 according to the first embodiment includes a microcomputer 21, a bus 22, a motor-driving interface device 24, a motor drive 25 that drives the DC motor 203, a motor-driving-current detector 301 serving as a detecting unit, the motor-angular-velocity detecting encoder 207 serving as a detecting unit, the driven-roller-angular-velocity detecting encoder 208 serving as a detecting unit, detection interface devices 302, 303, and 304 for these detecting units, an auxiliary-motor-driving interface device 305, an auxiliary-motor drive 306 that drives the auxiliary motor 209, an auxiliary-motor-driving-current detector 307, and an auxiliary-motor-drive-current detection interface device 308. The microcomputer 21 includes a microprocessor 21*a*, a read only memory (ROM) 21*b*, a random access memory (RAM) 21*c*, and the like. The microprocessor 21*a*, the ROM 21*b*, the RAM 21*c*, and the like are connected to each other via the bus 22.

The motor-angular-velocity detecting encoder 207 mounted on an output shaft of the DC motor 203 is connected to the motor-angular-velocity detection interface device 303 of the control device 200. The motor-angular-velocity detection interface device 303 converts an output of the motor-angular-velocity detecting encoder 207 into a digital value. More specifically, the motor-angular-velocity detection interface device 303 includes a counter that counts pulses output from the motor-angular-velocity detecting encoder 207, and outputs a digital value indicating a motor angular velocity derived from the pulse count to the microcomputer 21 via the bus 22.

The motor-driving interface device 24 generates, based on the digital value indicating a calculation result of a driving control input for the DC motor 203 obtained by the microcomputer 21, a pulsed driving signal (driving voltage) that causes a power semiconductor (e.g., a transistor) of the motor drive 25 to operate. Upon receiving application of the pulsed driving voltage, the DC motor 203 is driven at an angular velocity corresponding to the driving voltage. The driving current flowing through the DC motor 203 is detected by the motor-driving-current detector 301 that includes, for instance, a current probe. The detected current value is input to the microcomputer 21 via the motor-drive-current detection interface device 302 that includes an analog-to-digital (A/D) converter or the like.

As described above, the driven-roller-angular-velocity detecting encoder 208 is mounted on the rotary shaft of the driven roller 201 that supports the intermediate transfer belt 6 and connected to the driven-roller-angular-velocity detection interface device 304 of the control device 200. The driven-roller-angular-velocity detection interface device 304 has a similar configuration as that of the motor-angular-velocity detection interface device 303 described above and converts an output of the driven-roller-angular-velocity detecting encoder 208 into a digital value. More specifically, the driven-roller-angular-velocity detection interface device 304 includes a counter that counts pulses output from the driven-roller-angular-velocity detecting encoder 208, and outputs a digital value indicating an angular velocity of the driven roller 201 derived from the pulse count to the microcomputer 21 via the bus 22.

The auxiliary-motor-driving interface device 305 converts a result of estimation of the driving-load-torque variation amount output from the microcomputer 21 into a target current value. The auxiliary-motor-driving interface device 305 generates, based on the conversion result and a result of calculation of a corrective control amount (which will be described later) obtained by the microcomputer 21 by using the driving current value detected by the auxiliary-motor-driving-current detector 307, a pulsed driving signal (driving voltage) that causes a power semiconductor (e.g., a transistor) included in the auxiliary-motor drive 306 to operate. Upon receiving application of the pulsed driving voltage, the auxiliary motor 209 is driven at an angular velocity that depends on the driving voltage. The driving current flowing through the auxiliary motor 209 is detected by the auxiliary-motor-driving-current detector 307 that includes a current probe and the like. The detected current value is input to the microcomputer 21 via the auxiliary-motor-drive-current detection interface device 308 that includes an A/D converter or the like.

In the first embodiment, the microcomputer 21 calculates a variation amount of the driving load torque applied to the intermediate transfer belt 6 in real time (strictly, with a delay corresponding to a unit sampling time) by using, as an analytical model of the drive control system for the intermediate transfer belt 6, an analytical model of a 2-inertia system. Each of a side of the DC motor 203 and a side of the intermediate transfer belt 6, separated by the gear reducer mechanism 204, 205 serving as the specific drive transmission member that imparts spring characteristics having greatest effect on the drive transmission system, is regarded as an inertial system. Then, the 2-inertia system includes a motor portion representing the inertial system of the side of the DC motor 203 and a transfer unit portion representing the inertial system of the side of the intermediate transfer belt 6 that are connected with a torsion spring portion that includes the gear reducer mechanism 204, 205. More specifically, the microcomputer 21 functions as the external disturbance estimator, which will be described later, and performs real-time estimation of the variation in the load torque applied to the intermediate transfer belt 6 based on the driving current of the DC motor 203 detected by the motor-driving-current detector 301, the motor angular velocity detected by the motor-angular-velocity detecting encoder 207, and the driven-roller angular velocity detected by the driven-roller-angular-velocity detecting encoder 208 based on the analytical model. The microcomputer 21 determines a control amount for the auxiliary motor 209 for cancellation of a torque variation profile related to the estimation based on a result of the estimation, and inputs the control amount to the auxiliary-motor drive 306 via the auxiliary-motor-driving interface device 305. Thus, the auxiliary motor 209 is driven to exert a driving force (driving torque) that depends on the control amount, causing a torque of the secondary-transfer opposed roller 9 to change. As a result, a variation in load torque of the intermediate transfer belt 6 that may otherwise occur is cancelled. As a result, even when an impact that occurs when a transfer sheet enters the transfer nip of the secondary transfer unit is given to the intermediate transfer belt 6, the belt velocity of the intermediate transfer belt 6 can be kept constant without a variation.

A method for detecting the angular velocities, or, more specifically, a processing method for the motor-angular-velocity detection interface device 303 that processes an output of the motor-angular-velocity detecting encoder 207 and the driven-roller-angular-velocity detection interface device 304 that processes an output of the driven-roller-angular-velocity detecting encoder 208 will be described below. Because the functions of the detection interface devices 303 and 304 are identical to each other, an explanation is given of the motor-angular-velocity detection interface device 303 as an example.

Figure 5:
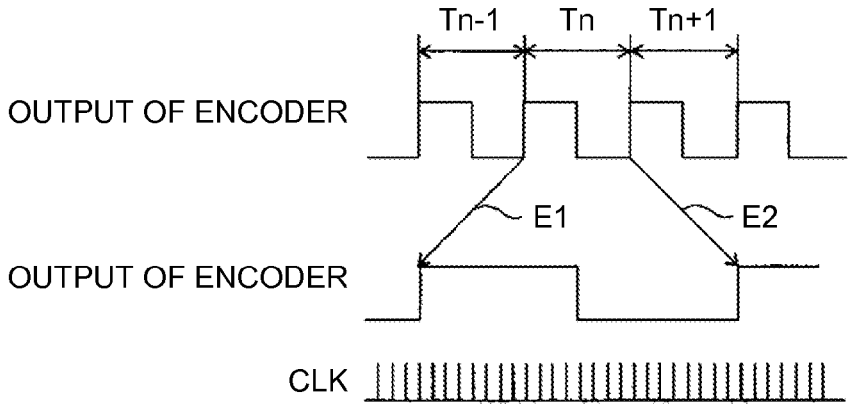
FIG. 5 is an explanatory diagram illustrating an encoder output of a motor-angular-velocity detecting encoder and reference clock.

FIG. 5 is an explanatory diagram illustrating an output of the motor-angular-velocity detecting encoder 207 and a reference clock CLK.

Figure 6:
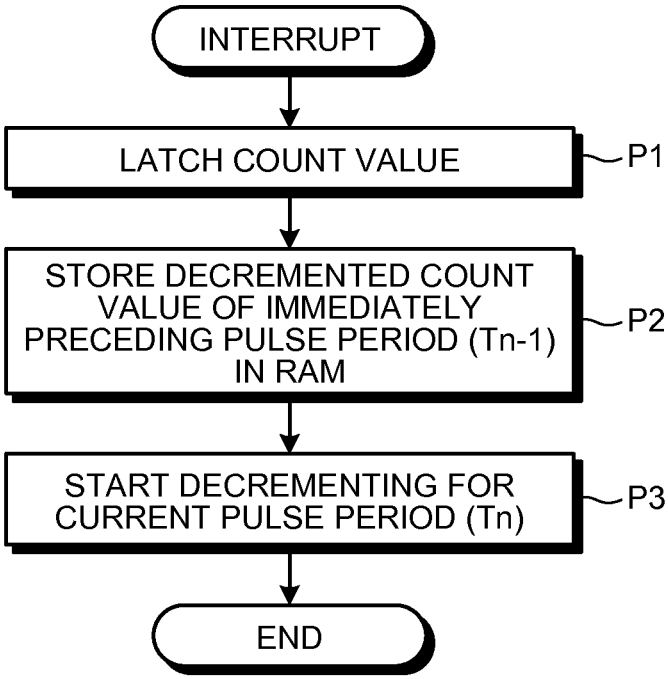
FIG. 6 is a flowchart illustrating an interruption routine to be executed by a microprocessor to detect a motor angular velocity.

FIG. 6 is a flowchart illustrating an interruption routine to be executed by the microprocessor 21*a* so as to detect the motor angular velocity.

An output terminal of the motor-angular-velocity detection interface device 303 is connected to an interruption of the microprocessor 21*a*. The motor-angular-velocity detection interface device 303 includes a timer that counts the reference clock CLK. The interruption routine will be described from a state immediately before an edge E1 of the encoder output pulse illustrated in FIG. 5 is detected. The counter (e.g., a hexadecimal counter) provided in the motor-angular-velocity detection interface device 303 counts the encoder output pulse by decrementing from a given count number (e.g., 0FFFFH) in accordance with the reference clock CLK. When the edge E1 reaches the interruption of the microprocessor 21*a*, the interruption routine illustrated in FIG. 6 is executed. When the interruption routine is initiated, the decremented count number output from the counter is latched into an internal register of the motor-angular-velocity detection interface device 303 (P1). The latched decremented count number is then stored in the RAM 21*c* illustrated in FIG. 4 (P2). A count initial value (0FFFFH) for counting of a pulse period Tn is input to start decrementing the counting again (P3). Then, the interruption processing ends. When a next edge E2 is detected, operations from P1 to P3 are repeated.

A velocity V(i) in the pulse Tn is obtained from the following Equation (1):

$$V(i)=k/(T\text{clk}\times Ne\times n) \quad (1)$$

where "Tclk" is a period of the reference clock CLK, "Ne" is a number of partitions, into which an encoder is partitioned, per unit angle, "n" is a count number of the reference clock CLK, which corresponds to "(0FFFFH)—(the decremented count number)" in the first embodiment, and "k" is a constant used for converting the unit of the right-hand side of Equation (1) to have a unit of velocity.

Figure 7:
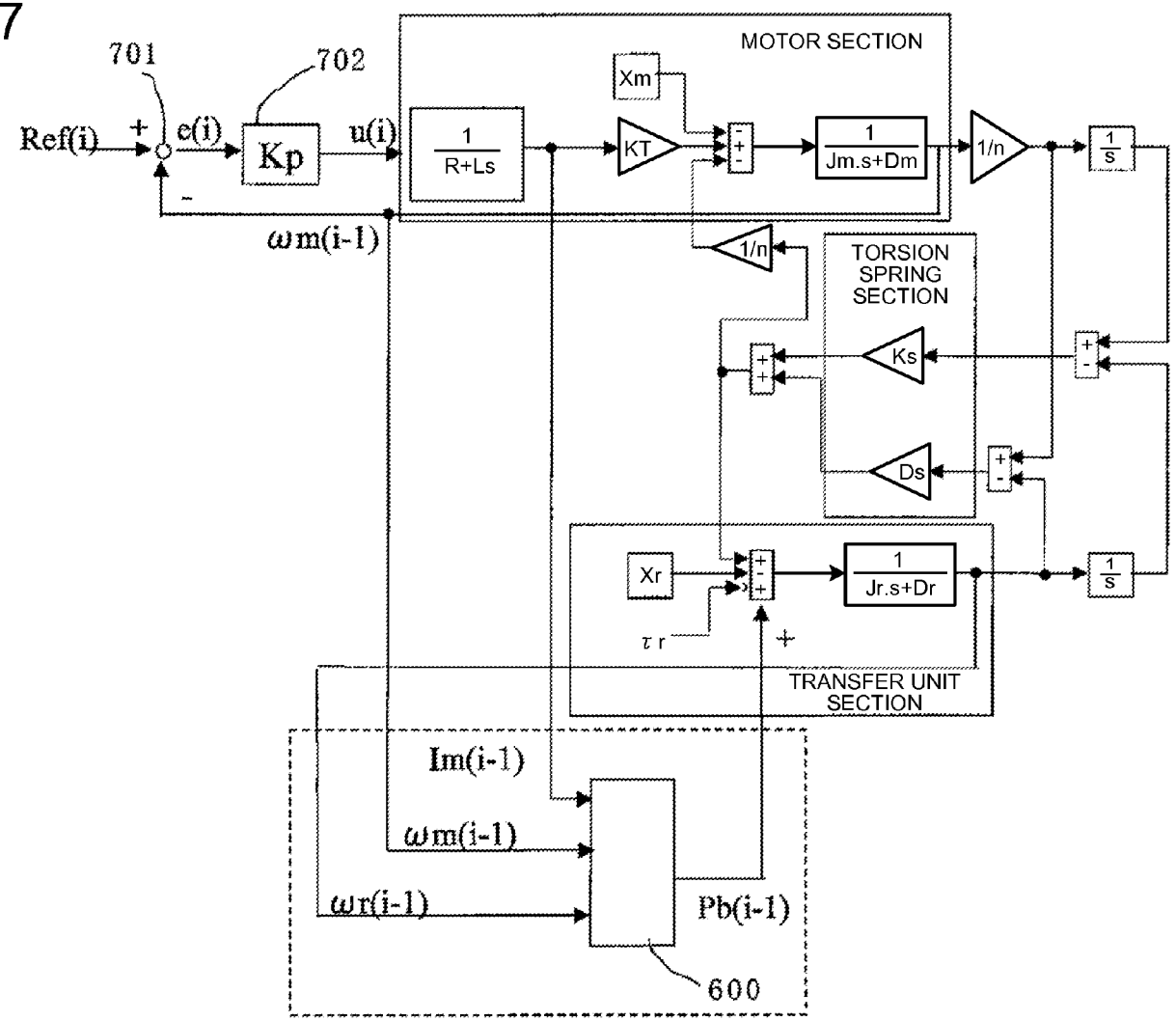
FIG. 7 is an explanatory diagram for explaining an analytical model of a 2-inertia system representing the drive control system for the intermediate transfer belt according to the first embodiment.

FIG. 7 is an explanatory diagram for the analytical model of the 2-inertia system representing the drive control system for the intermediate transfer belt 6 according to the first embodiment.

As described above, the drive control system for the intermediate transfer belt 6 according to the first embodiment can be considered as the 2-inertia system that includes the motor portion and the transfer unit portion connected via a joint portion provided on a shaft portion between the two inertial systems. In particular, the transfer unit portion can be considered as the single inertial system in the first embodiment because the intermediate transfer belt 6 has high rigidity (low elasticity) and receives a high tension that is applied to the intermediate transfer belt 6 so that the surface movement of the intermediate transfer belt 6 and rotations of the driving roller 7 and driven rollers 9, 201, and 202 can be considered as those of rigid bodies free from slippage. Furthermore, torsion spring characteristics and viscous characteristics about a shaft of the joint portion are taken into account as primary resonance elements. Furthermore, each of the viscosity coefficient about the rotary shaft 206 of the driving roller 7 of the intermediate transfer belt 6 and the viscosity coefficient about the output shaft of the DC motor 203 is taken into account as an attenuation characteristic in a corresponding one of the inertial systems. The joint portion is assumed as something like a virtual solid coupling that would not physically exist in the real world and treated as having no inertia, or, put another way, as having no moment of inertia.

An example of a method for determining the parameters in the analytical model illustrated in FIG. 7 will be described below.

When designing the drive control system for the intermediate transfer belt 6, a prototype of a driving mechanism of the intermediate transfer belt 6 as illustrated in FIG. 3 is constructed. In an experiment, frequency responses of control elements between an input, which is a target of the feedback control of the drive control system, that is a driving current to be input to the DC motor 203 and an output that is up to an angular velocity of the driving roller 7 of the intermediate transfer belt 6 are measured.

Subsequently, a transfer function of this input/output model is determined. Of the parameters in the analytical model illustrated in FIG. 7, values other than a viscosity coefficient Dm of the motor portion, a stationary load Xm of the motor portion, a viscosity coefficient Dr of the transfer unit portion, and a stationary load Xr of the transfer unit portion can be calculated easily from design values. Accordingly, an example for calculating these four parameters only will be described below.

To calculate the viscosity coefficient Dm of the motor portion and the stationary load Xm of the motor portion, the following experiment is to be carried out by using a prototype or the like of the motor portion alone.

A driving current and a motor angular velocity of the DC motor 203 driven with a constant current are actually measured by using an ampere meter and a tachogenerator, or the like, thereby obtaining time-series data about the driving current and the motor angular velocity of the DC motor 203. The viscosity coefficient Dm of the motor portion is calculated from the time-series data about the motor angular velocity by using a mechanical time constant of the motor portion. Then, the stationary load Xm of the motor portion is calculated by using an equation of rotational motion. More specifically, when it is assumed that the motor portion is a single inertial system (one moment of inertia) by including even inertia of the gears into the inertia of the motor shaft and that the viscosity coefficient Dm of the motor portion is a primary delay element, the transfer function Gm(s) and a time constant Ta of the model where the input is the driving current and the output is the motor angular velocity are given by the following Equation (2) and Equation (3), respectively. In Equations (2) and (3) below, "K" denotes a constant of proportionality of the primary delay system, "s" is a Laplacian operator, and "Jm" is a moment of inertia of the motor portion.

$$Gm(s)=K/(Ta\times s+1) \quad (2)$$

$$Ta=Jm/Dm \quad (3)$$

By calculating back from the fact that the motor angular velocity reaches approximately 63.2% of the motor angular velocity in the steady state (an angular velocity of the DC motor 203 after an elapse of a sufficiently-long period of time since the motor starts rotation) after the time period Ta has elapsed since the DC motor 203 starts the rotation, the mechanical time constant Ta of the motor portion is obtained from the time-series data about the motor angular velocity. By substituting the known moment of inertia Jm of the motor portion, the viscosity coefficient Dm of the motor portion is calculated. Equation (4) below is obtained after removal of the inertial term from the equation of rotational motion of the motor portion by using a motor angular velocity ωm, which is a final value (steady-state value) of the time-series data about the motor angular velocity. Then, the viscosity coefficient Dm of the motor portion can be calculated from Equation (4). In Equation (4), "Ke" is a torque constant of the DC motor 203, and "j" is a driving current of the DC motor 203.

$$Ke \times j = Dm \times \omega m + Xm \quad (4)$$

To calculate the viscosity coefficient Dr of the transfer unit portion and the stationary load Xr of the transfer unit portion, the following experiment is to be carried out by using whole of the intermediate transfer unit, an example of which is illustrated in FIG. 3.

To calculate the viscosity coefficient Dr of the transfer unit portion and the stationary load Xr of the transfer unit portion, the driving current of the DC motor 203, the motor angular velocity of the same, and the angular velocity of the driving roller 7 are measured by using, for example, the ampere meter, the tachogenerator, and an encoder, respectively, thereby obtaining time-series data about the angular velocity of the driving roller 7. As in the case of the motor portion, the viscosity coefficient Dr of the transfer unit portion is calculated by using a mechanical time constant, and the stationary load Xr of the transfer unit portion is calculated from the equation of rotational motion. More specifically, by assuming that the motor portion and the transfer unit portion form the 2-inertia system and that the viscosity coefficient Dm of the motor portion and the viscosity coefficient Dr of the transfer unit portion are, respectively, primary delay elements of the corresponding inertial systems, the transfer function Gr(s) and a time constant Tb (mechanical time constant of the motor portion plus the transfer unit portion) of the model, where the input is the driving current of the DC motor 203 and the output is the angular velocity of the driving roller 7, are given by Equation (5) and Equation (6) below, respectively. In Equations (5) and (6), "Jr" is a moment of inertia of the transfer unit portion, and "n" is a speed reduction ratio.

$$Gr(s) = K/(Tb \times s + 1) \quad (5)$$

$$Tb = (n^2 \times Jm + Jr)/(n^2 \times Dm + Dr) \quad (6)$$

As in the case of the time constant Ta of the motor portion described above, the time constant Tb is obtained from the time-series data about the angular velocity of the driving roller 7. Then, by using the known moments of inertia Jm and Jr and the calculated viscosity coefficient Dm of the motor portion, the viscosity coefficient Dr of the transfer unit portion is calculated. As in the motor portion, removing the inertial term by using a motor angular velocity or of the driving roller 7, which is a final value (steady-state value) of the time-series data about the motor angular velocity of the driving roller 7, from the equation of rotational motion concerning the transfer unit portion, gives Equation (7) below, from which the stationary load Xr of the transfer unit portion can be calculated.

$$Ke \times j = Dm \times \omega m + Xm + (Dr \times \omega r + Xr)/n \quad (7)$$

A transfer function from the driving current input to the DC motor 203 to an angular velocity or an angular displacement of the driving roller 7 is obtained by experiment. When the DC motor 203 is determined, the torque constant Ke of the motor portion is determined. Accordingly, by multiplying the torque constant Ke of the DC motor 203 to the driving current input to the DC motor 203, the transfer function from the torque of the DC motor 203 to the angular velocity or the angular displacement of the driving roller 7 is obtained easily.

A method to calculate a torsional spring constant of the joint portion in the analytical model illustrated in FIG. 7 will be described below.

A torsional spring constant Ks of the joint portion is calculated by neglecting the viscosity coefficient Ds of the joint portion. A primary resonance frequency f of the 2-inertia system can be obtained from Equation (8) below when the viscosity coefficient Ds of the joint portion is neglected.

$$F = \{Ks \times (Jm + Jr)/(Jm \times Jr)\}^{1/2}/2\pi \quad (8)$$

The Equation (8) can be modified so that the left hand side of an equation becomes a torsional spring constant Ks of the joint portion, as seen in Equation (9).

$$Ks = (2\pi \times f)^2 \times (Jm \times Jr)/(Jm + Jr) \quad (9)$$

Accordingly, the torsional spring constant Ks of the joint portion can be calculated by determining the primary resonance frequency f by experiment and substituting the known moment of inertia Jm of the motor portion and the known moment of inertia Jr of the transfer unit portion into Equation (9). Meanwhile, the primary resonance frequency f can be obtained as a lowest frequency among peak values in a gain-phase diagram that is obtained by performing actual measurement of frequency responses.

When the torsional spring constant Ks has been obtained in this manner, subsequently, the viscosity coefficient Ds of the joint portion is determined so that an attenuation characteristics of the primary resonance obtained by a real measurement substantially coincides with an attenuation characteristics of the primary resonance obtained from the analytical model. The attenuation characteristics of the primary resonance and the viscosity coefficient Ds of the joint portion are in one-to-one correspondence. Accordingly, changing the viscosity coefficient Ds of the joint portion also causes a change in the attenuation characteristics of the primary resonance. Therefore, the viscosity coefficient Ds of the joint portion can be determined by performing simulations with different values for the viscosity coefficient Ds of the joint portion and comparing a result of the simulations with a result of real measurement of the frequency responses performed on frequencies in the vicinity of the primary resonance frequency.

A motor control unit included in the analytical model illustrated in FIG. 7 will be described below.

In FIG. 7, a motor angular velocity ωm(i−1) output from the motor-angular-velocity detection interface device 303 that processes output pulse signals of the motor-angular-velocity detecting encoder 207 is input to a calculation unit (subtracter) 701. The calculation unit 701 calculates a difference e(i) between a control target value (hereinafter, "target motor angular velocity") Ref(i) and the motor angular velocity ωm(i−1) of the DC motor 203. The difference e(i) is input to a controller unit 702. The controller unit 702 is, for instance, formed by a proportional (P) control system. A driving voltage u(i) of the DC motor 203 is determined by multiplying e(i) calculated by the calculation unit 701 by a constant of proportionality Kp. Furthermore, pulsed driving signals are generated by the motor-driving interface device 24 and the motor drive 25 based on the driving voltage u(i). The DC motor 203 is driven by the driving signals accordingly.

Meanwhile, in this example, the P control system is used as the example of the controller unit 702; however, the controller unit 702 is not limited thereto. All the calculations described above are performed as numerical calculations by the microcomputer 21 and can be implemented easily.

A torque-exertion-control-amount setting unit 600 in the analytical model illustrated in FIG. 7 will be described below.

In the first embodiment, parameters, or, more specifically, a driving current Im(i−1) of the DC motor, the motor angular velocity ωm(i−1) of the DC motor 203, and a driven-roller angular velocity ωr(i−1) of the intermediate transfer belt 6, are input to the torque-exertion-control-amount setting unit 600. Based on these parameters, the torque-exertion-control-amount setting unit 600 obtains an estimated value of an external disturbance τr, which is a torque variation occurring on an inertial member when an intermediate transfer unit that is the intermediate transfer belt 6 is regarded as an inertial system, thereby setting a torque-exertion control amount to be exerted by the auxiliary motor 209 for cancellation of the external disturbance τr based on the estimated value. An output Pb(i−1) of the torque-exertion-control-amount setting unit 600 is input to the auxiliary-motor drive 306 via the auxiliary-motor-driving interface device 305 illustrated in FIG. 4. The external disturbance τr corresponds to a torque variation of the intermediate transfer belt 6 that occurs when a transfer sheet enters the transfer nip. Accordingly, insofar as the value of the external disturbance τt coincides with the value of the output Pb(i−1), which is to be input to the auxiliary-motor drive 306, of the torque-exertion-control-amount setting unit 600, the external disturbance τr is cancelled by the driving force exerted by the auxiliary motor 209 in the transfer unit portion in the analytical model. Accordingly, the external disturbance τr does not affect other portions. That is, in this analytical model, the external disturbance τr can be ignored, and hence the torque variation of the intermediate transfer belt 6, which may otherwise occur, does not occur when the transfer sheet enters the transfer nip.

Figure 8:
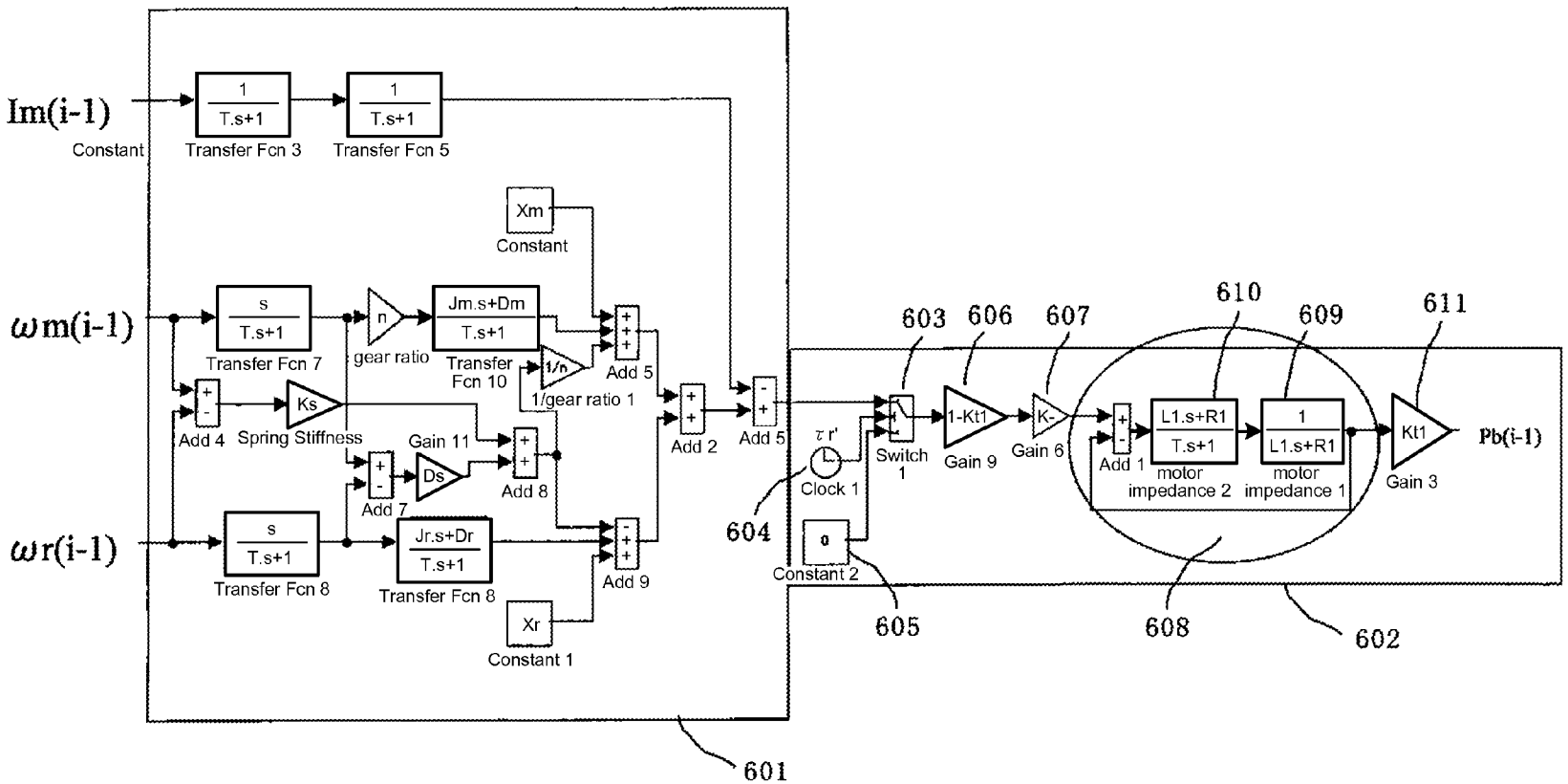
FIG. 8 is a control block diagram of a torque-exertion-control setting unit in the analytical model according to the first embodiment.

FIG. 8 is a control block diagram of the torque-exertion-control-amount setting unit 600.

The torque-exertion-control-amount setting unit 600 includes an external disturbance estimator 601 based on the analytical model of the 2-inertia system illustrated in FIG. 7 and an adjusting unit 602. In FIG. 8, "T" denotes a time constant of a low-pass filter for stabilizing operation of the external disturbance estimator 601.

The adjusting unit 602 will be described below.

In the description below, C1 is an adjustment coefficient for use in correcting an output τr' of the external disturbance estimator 601 to thereby optimize the output τr'.

Because the angular velocity of the intermediate transfer belt 6 is likely to oscillate immediately after the intermediate transfer belt 6 starts the rotation, it is necessary not to perform external disturbance estimation immediately after the rotation. In view of this, control in the first embodiment is performed as described below.

In the adjusting unit 602, the output τr' of the external disturbance estimator 601 is input to a switch block 603. The switch block 603 is configured, for instance, to output zero from a block 605 until a certain period of time elapses after the DC motor 203 starts the rotation in accordance with an output of a timer 604 and to output the output τr' of the external disturbance estimator 601 after the elapse of the certain period of time. This makes it possible not to perform the external disturbance estimation at the starting as described above.

The output of the switch block 603 is input to a block 606. The block 606 provides an inverse of a torque constant of the auxiliary motor 209; accordingly, the block 606 converts the output τr' of the external disturbance estimator 601 into a current value.

An output of the block 606 is input to a block 607. The block 607 provides a correction coefficient, which is to be multiplied to the output τr' of the external disturbance estimator 601 so as to correct the output τr'. The driving force to be exerted by the auxiliary motor 209 is controlled with a torque variation profile that has an opposite sign to a torque variation profile of the estimated driving load torque. Therefore, the correction coefficient has an arbitrary negative value (that is, "−C1"). The output of the block 607 serves as a target electric current of an electric-current control system 608 for the auxiliary motor 209.

A block 609 of the electric-current control system 608 for the auxiliary motor 209 is an impedance part of the auxiliary motor 209. A block 710 is a feedback gain of the electric-current control system 608 for the auxiliary motor 209. In this example, an inverse of the motor impedance is assigned to a numerator of a fraction of the feedback gain so that the block 710 and a block 709 set a value for a primary low-pass filter to thereby stabilize the electric-current control system 608. An output of the block 609 is the driving current for the auxiliary motor 209. The driving current is measured by the auxiliary-motor-driving-current detector 307 and the auxiliary-motor-drive-current detection interface device 308 and subjected to the feedback control.

In this analytical model, the driving current controlled to the target electric current is input to the auxiliary motor 209. Accordingly, a torque-constant block 611 of the auxiliary motor 209 outputs Pb(i−1) having an opposite phase to the external disturbance τr.

Meanwhile, as in the controller unit 702 described above, all the calculations related to the torque-exertion-control-amount setting unit 600 are performed as numerical calculations by the microcomputer 21, and hence can be implemented easily.

An example of a result of a simulation with regard to an effect obtained by the first embodiment will be described below.

Figure 1:
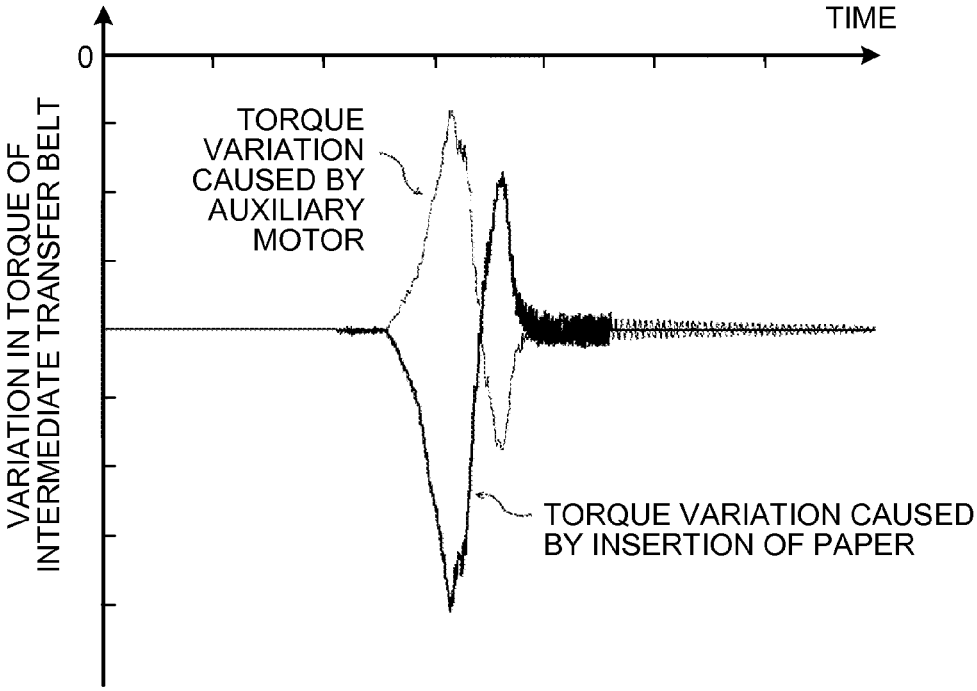
FIG. 1 is a graph illustrating torque variation (thick line) of an intermediate transfer belt caused by an impact occurring when a transfer sheet enters a transfer nip of a printer and torque variation (thin line) of the intermediate transfer belt caused by a control device according to a first embodiment.

In FIG. 1, a torque variation for the intermediate transfer belt 6 that occurs when a transfer sheet enters the transfer nip is indicated by the thick line. An example of an output of the torque-exertion-control-amount setting unit 600 is indicated by the thin line. Note that, in FIG. 1, the greater the absolute value of a torque with a negative sign, of the intermediate transfer belt 6, the greater the driving load torque applied to the intermediate transfer belt 6. As shown in the graph, in a state where torque of the intermediate transfer belt 6 does not vary, the output example of the torque-exertion-control-amount setting unit 600 coincides with the driving load torque applied to the intermediate transfer belt 6, showing that, according to the first embodiment, in the state where torque of the intermediate transfer belt 6 does not vary, neither a braking force (load torque) nor a driving force (driving torque) is exerted by the auxiliary motor 209. Because the waveforms in the graph of FIG. 1 have opposite phases to each other, the summation of the waveforms shows a nearly constant waveform.

Figure 9:
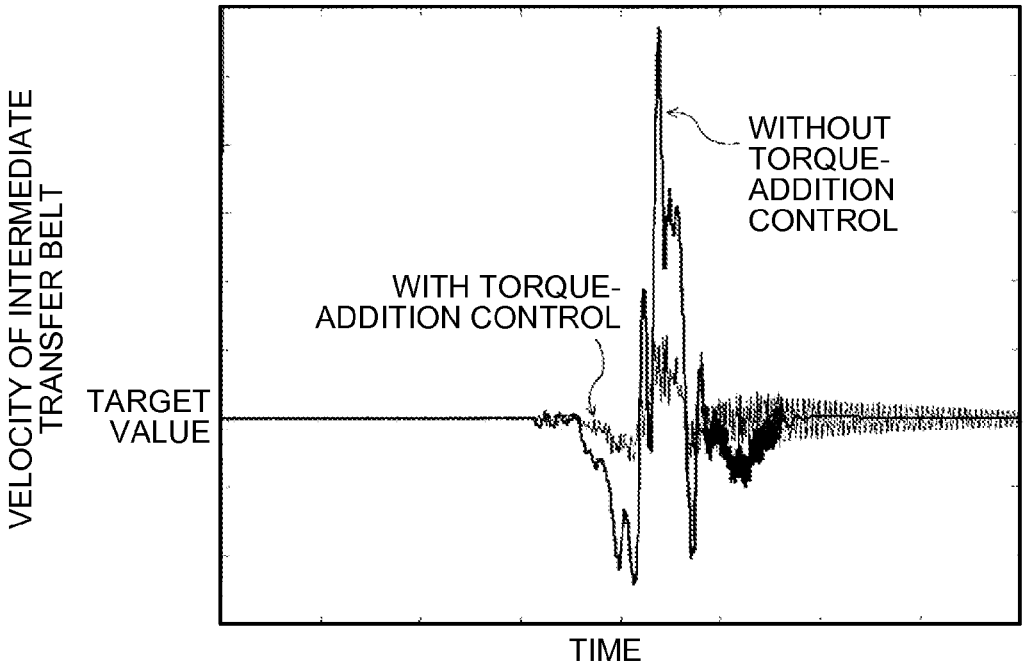
FIG. 9 is a graph, according to the first embodiment, of variation in velocity of the intermediate transfer belt for comparison between a case (thin line) where torque-exertion control is performed on an auxiliary motor by the control device and a case (thick line) where the control is not performed.

FIG. 9 is a graph to compare the velocity variations of the intermediate transfer belt 6 with (thin line) and without (thick line) torque-exertion control on the auxiliary motor 209 performed by the control device 200 according to the first embodiment.

This graph shows that, according to the first embodiment, even when an impact that occurs when a transfer sheet enters the transfer nip is applied to the intermediate transfer belt 6, it is possible to sufficiently suppress a variation in the velocity of the intermediate transfer belt 6 caused by the impact.

Second Embodiment

Another embodiment (hereinafter, referred to as "second embodiment") when the present invention is applied to a copying machine serving as the image formation apparatus will be described below as in the first embodiment.

The second embodiment is similar to the first embodiment with a difference from the first embodiment only in that the velocity of the intermediate transfer belt 6 is to be detected. Therefore, only the difference will be described below.

Figure 10:
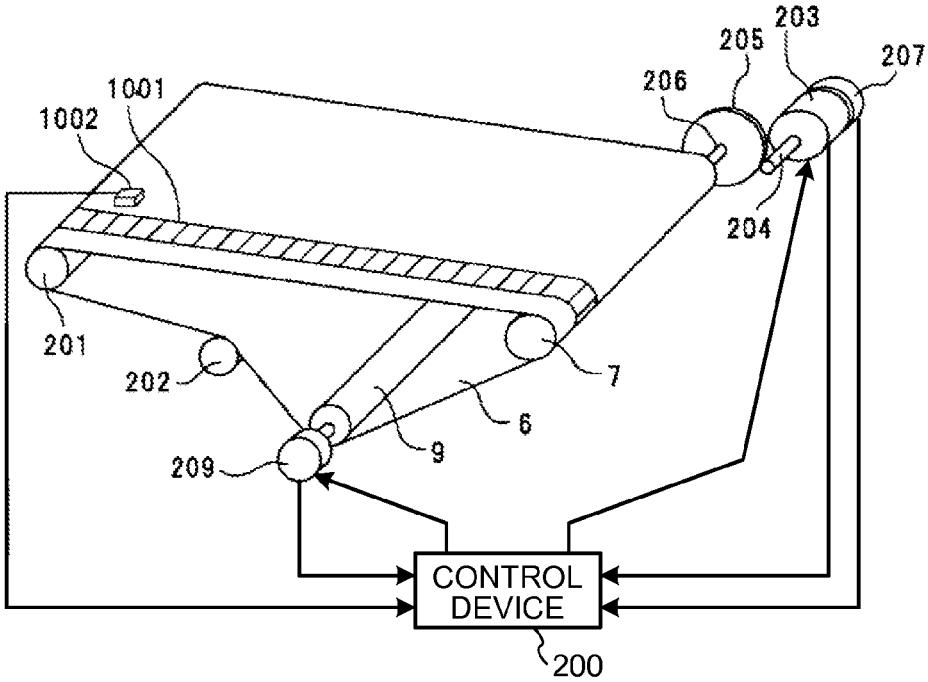
FIG. 10 is an explanatory diagram illustrating a configuration related to driving control of an intermediate transfer belt of a printer according to a second embodiment.

FIG. 10 is an explanatory diagram of the configuration related to driving control of the intermediate transfer belt 6 according to the second embodiment.

In the first embodiment, the angular velocity of the driven roller 201 of the intermediate transfer belt 6 is detected when the torque variation occurring on the inertial member, that appears when the intermediate transfer unit portion is regarded as an inertia system, is to be determined. However, in the second embodiment, the torque variation of the inertial member that appears when the intermediate transfer unit portion is regarded as an inertia system is determined by observing an outer peripheral surface of the intermediate transfer belt 6 to thereby directly detect the velocity of the intermediate transfer belt 6 and converting the velocity into the angular velocity of the driven roller 201. A method for detecting a surface moving velocity of the intermediate transfer belt 6 will be specifically described below. A large number of markers 1001 are provided around the intermediate transfer belt 6 at an edge region in a belt width direction on the outer peripheral surface of the intermediate transfer belt 6. A marker sensor 1002 is provided so as to face the outer peripheral surface of the intermediate transfer belt 6 to detect the markers 1001. The markers 1001 and the marker sensor 1002 form a detecting unit. The markers 1001 are arranged at a regular interval in a surface moving direction of the intermediate transfer belt 6. The marker sensor 1002 includes a photo-interrupter or the like. The marker sensor 1001 outputs "1" of a digital signal when the marker sensor 1001 faces at least one of the markers 1002. The marker sensor 1002 outputs "0" of a digital signal when the marker sensor 1002 faces a belt surface portion between the markers 1001. By counting the digital signals output from the marker sensor 1002, the surface moving velocity of the intermediate transfer belt 6 can be detected.

Figure 11:
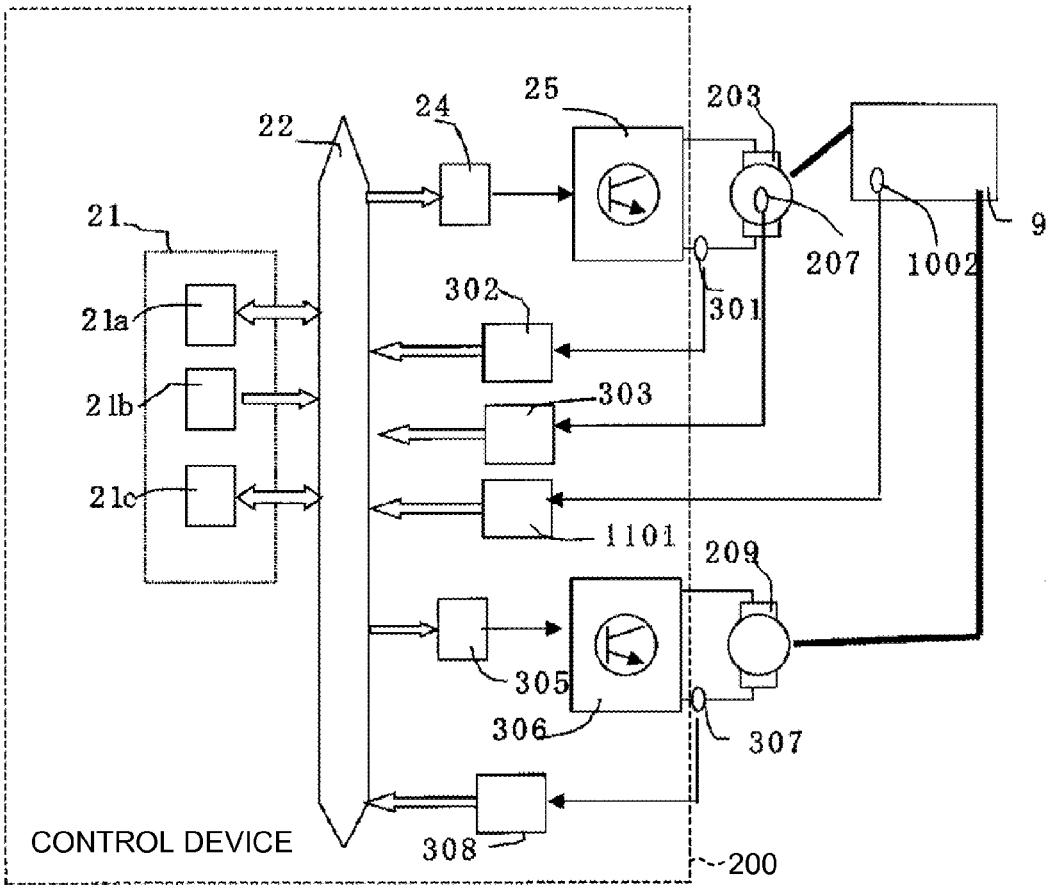
FIG. 11 is a hardware block diagram for explaining a drive control system of the intermediate transfer belt formed by the control device of the printer according to the second embodiment.

FIG. 11 is a hardware block diagram for explaining a drive control system of the control device 200 for controlling the intermediate transfer belt 6 according to the second embodiment.

In the second embodiment, an output of the marker sensor 1002 is input to a belt-velocity detection interface device 1101 of the control device 200 and is input to the microcomputer 21 as information about the belt velocity. The function of the belt-velocity detection interface device 1101 is similar to that of the driven-roller-angular-velocity detection interface device 304 of the first embodiment.

Figure 12:
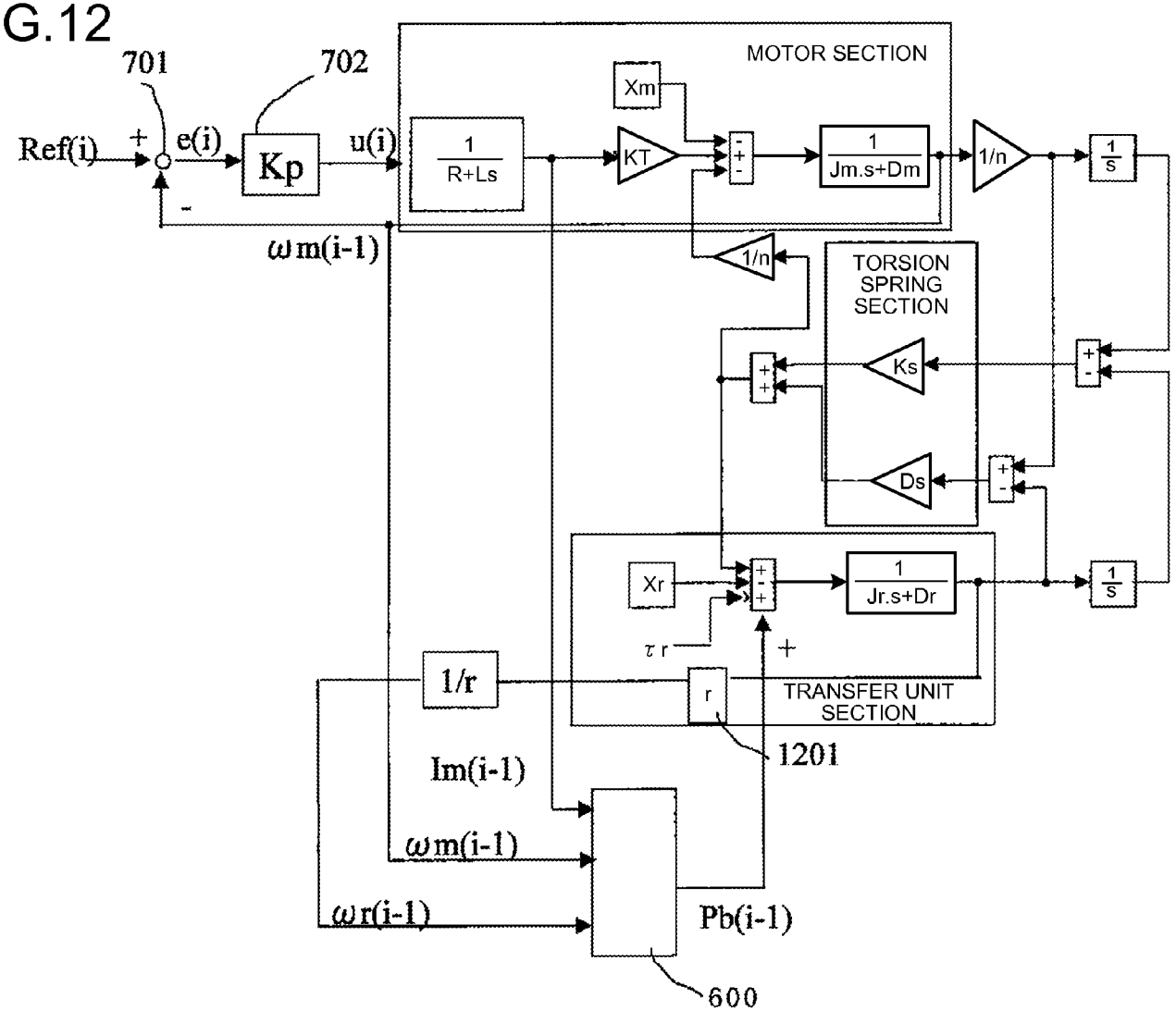
FIG. 12 is an explanatory diagram for explaining an analytical model of a 2-inertia system representing the drive control system for the intermediate transfer belt according to the second embodiment.

FIG. 12 is an explanatory diagram of an analytical model of a 2-inertia system representing a drive control system for the intermediate transfer belt 6 according to the second embodiment.

In the second embodiment, the belt velocity of the intermediate transfer belt 6 to be detected by the marker sensor 1002 corresponds to a product of the angular velocity of the driven roller 201 and r, which is the radius of the driven roller 201, or, in other words, corresponds to an output value of a block 1201 in the analytical model illustrated in FIG. 12. Accordingly, by dividing the belt velocity (i.e., the output value of the block 1201) that is detected by the marker sensor 1002 and the belt-velocity detection interface device 1101 and then input to the microcomputer 21 by r, which is the radius of the secondary-transfer opposed roller 9 where the auxiliary motor 209 is attached, $\omega r(i-1)$ presented in FIG. 7 is obtained. Accordingly, the analytical model illustrated in FIG. 12 is obtained as the analytical model according to the second embodiment.

In the second embodiment, description has been given of the example in which the marker sensor 1002 detects at least one of the large number of the markers 1001 provided on the outer peripheral surface of the intermediate transfer belt 6, thereby detecting the surface moving velocity of the intermediate transfer belt. Alternatively, the surface moving velocity of the intermediate transfer belt 6 may be directly detected by, for example, performing measurement utilizing the Doppler effect.

Third Embodiment

An explanation will be given below of a still another embodiment (hereinafter, referred to as "third embodiment"), in which the present invention is applied to a copying machine, corresponding to the image formation apparatus, as in the first embodiment and the second embodiment.

The third embodiment is similar to the first embodiment with a difference from the first embodiment only in that the driving force exerted by the auxiliary motor 209 is applied to the intermediate transfer belt 6. Therefore, only the difference will be described below.

Figure 13:
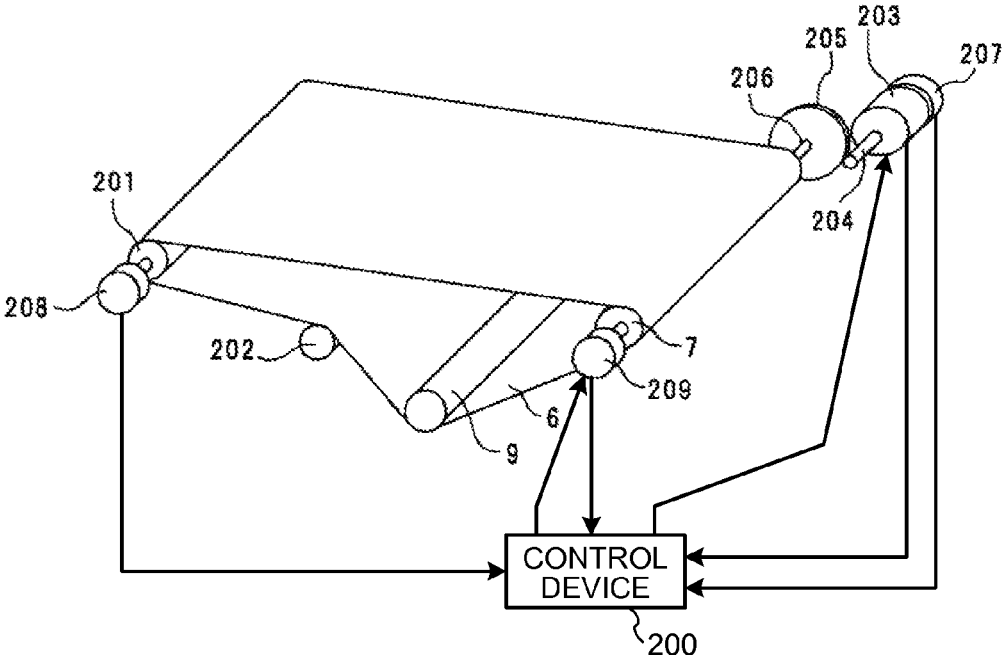
FIG. 13 is an explanatory diagram illustrating a configuration related to driving control of the intermediate transfer belt of a printer according to a third embodiment.

FIG. 13 is an explanatory diagram of the configuration related to driving control of the intermediate transfer belt 6 according to the third embodiment.

In the first embodiment, the auxiliary motor 209 is attached via the coupling (not shown) to the rotary shaft of the secondary-transfer opposed roller 9. In contrast, in the third embodiment, the auxiliary motor 209 is attached via a coupling (not shown) to the rotary shaft 206 of the driving roller 7 of the intermediate transfer belt 6. As described above, in the third embodiment, a driving system of the intermediate transfer belt 6 can be regarded as an integrally movable portion formed by the outer peripheral surface of the intermediate transfer belt 6, the driven rollers 9, 201, and 202 supporting the intermediate transfer belt 6, and the driving roller 7. Accordingly, the configuration according to the third embodiment, in which the driving force exerted by the auxiliary motor 209 is applied to the driving roller 7 to apply a driving torque to the intermediate transfer belt 6, can yield a similar effect to that yielded by the configuration according to the first embodiment, in which the driving force exerted by the auxiliary motor 209 is applied to the secondary-transfer opposed roller 9, which is a driven roller.

Fourth Embodiment

Still another embodiment (hereinafter, referred to as "fourth embodiment"), in which the present invention is applied to a copying machine, corresponding to the image formation apparatus, will be described below as in the first to third embodiments.

The fourth embodiment differs from the first embodiment primarily in that a drum-like image carrier instead of the belt-like image carrier is used.

Figure 14:
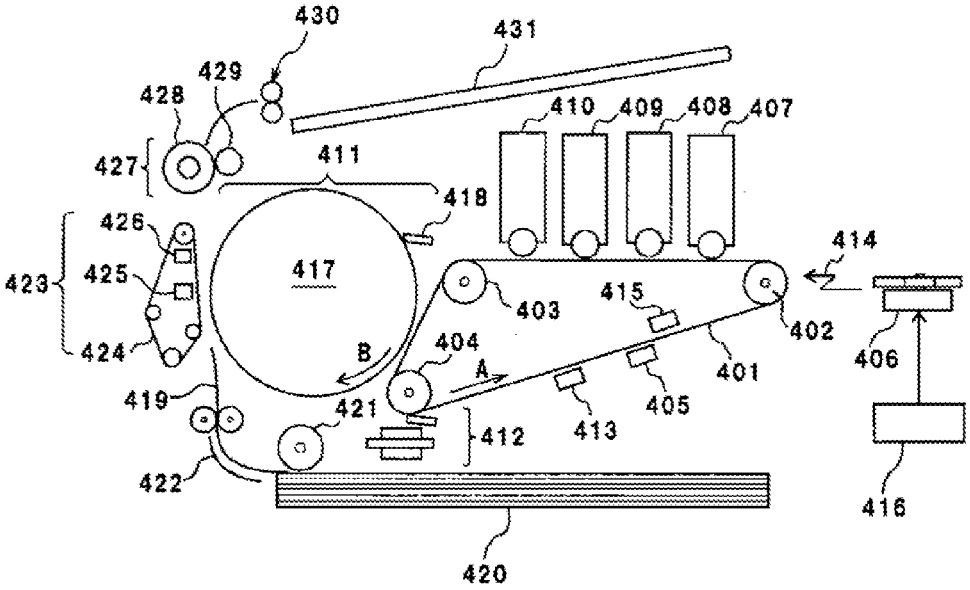
FIG. 14 is a schematic configuration diagram of a printer according to a fourth embodiment.

FIG. 14 is a schematic configuration diagram of a printer according to the fourth embodiment.

In FIG. 14, a photosensitive belt 401, serving as a latent-image carrier, is an endless photosensitive belt formed by laminating a photosensitive layer of an organic photo conductor (OPC) or the like on an outer peripheral surface of a closed-loop non-luminescent (NL) belt substrate. The photosensitive belt 401 is supported by photosensitive-element conveying rollers 402 to 404 serving as three supporting rotors, and rotated in a direction indicated by an arrow A in FIG. 14 by a drive motor (not shown).

An electrostatic charging unit 405, an exposure optical system (a laser scanning unit, which is hereinafter referred to as "LSU") 406 serving as an exposure unit, a black developing unit 407, a cyan developing unit 408, a magenta developing unit 409, and a yellow developing unit 410, an intermediate transfer unit 411, a photosensitive-element cleaning unit 412, and a neutralization device 413 are provided around the photosensitive belt 401 in this order along the photosensitive-element rotating direction indicated by the arrow A. The electrostatic charging unit 405, to which a high voltage of approximately −4 kV to −5 kV is applied from a power supply device (not shown), electrostatically charges a portion of the photosensitive belt 401 that faces the electrostatic charging unit 405, thereby causing the portion to carry a potential with a uniform charge distribution.

A laser driving circuit (not shown) sequentially performs light-intensity modulation or pulse-width modulation on image signals of the colors input from a tone converting unit (not shown) to output modulated signals. The LSU 406 drives a semiconductor laser (not shown) by the modulated signals, thereby obtaining exposure light beams 414 that scan the photosensitive belt 401 to sequentially form electrostatic latent images, on the photosensitive belt 401, according to the image signals of the corresponding colors. A joint-line sensor 415 detects a joint line of the photosensitive belt 401 formed into a loop. When the joint-line sensor 415 detects the joint line of the photosensitive belt 401, a timing controller 416 controls light emission timing of the LSU 406 so that the joint line of the photosensitive belt 401 can be avoided and that electrostatic latent images of the colors are formed at a same angular displacement.

Each of the developing units 407 to 410 stores toner of a color corresponding to the developing color. Each of the developing units 407 to 410 selectively comes into contact with the photosensitive belt 401 at a timing that depends on the electrostatic latent image corresponding to an image signal of each color on the photosensitive belt 401 and develops each of the electrostatic latent images with toner, thereby forming a full-color image by overlaying the images of the four colors on top of another.

The intermediate transfer unit 411 includes a drum-like intermediate transfer member (intermediate transfer drum) 417, that is the image carrier, and a blade-like intermediate-transfer-member cleaning unit 418, that is made from rubber or the like. The intermediate transfer drum 417 is made by wrapping a metal tubing, such as an aluminum tubing, with a belt-like sheet made from a conductive resin or the like. While the images of the four colors are being overlaid on the intermediate transfer drum 417, the intermediate-transfer-member cleaning unit 418 is separated away from the intermediate transfer drum 417. The intermediate-transfer-member cleaning unit 418 comes into contact with the intermediate transfer drum 417 only when cleaning of the intermediate transfer drum 417 is to be performed, and removes residual toner left on the intermediate transfer drum 417 without being transferred therefrom onto recording paper 419 serving as the recording medium. The recording paper is input from a recording-paper cassette 420 by a paper feeding roller 421, one by one, to a conveying path 422 of a transfer sheet 40.

A transfer unit 423 serving as a transferring means transfers the full-color image on the intermediate transfer drum 417 onto the recording paper 419. The transfer unit 423 includes a belt-like transfer belt 424 made of conductive rubber or the like, a transfer device 425 that applies, to the intermediate transfer drum 417, a transfer bias to transfer the full-color image on the intermediate transfer drum 417 onto the recording paper 419, and a separator 426 that applies, to the intermediate transfer drum 417, a bias that prevents the recording paper 419, onto which the full-color image has been transferred, from electrostatically sticking to the intermediate transfer drum 417.

A fixing unit 427 includes a heating roller 428, which internally includes a heat source, and a pressing roller 429. The fixing unit 427 applies pressure and heat to the recording paper 419, onto which the full-color image is transferred, while the recording paper 419 is nipped between the heating roller 428 and the pressing roller 429 that rotate, thereby fixing the full-color image onto the recording paper 419. The full-color image is thus formed.

Image formation configured as described above operates as follows. Here, an explanation will be given by assuming that the development of an electrostatic latent image is performed in the order of black, cyan, magenta, and yellow.

The photosensitive belt 401 is driven by its driving source (not shown) in the direction indicated by an arrow A, while the intermediate transfer drum 417 is driven by its driving source (not shown) in a direction indicated by an arrow B. In this state, first, a high voltage of approximately −4 kV to −5 kV is applied to the electrostatic charging unit 405 from the power supply device (not shown). The electrostatic charging unit 405 electrostatically charges the surface of the photosensitive belt 401 uniformly so that a potential reaches approximately −700 V. Subsequently, the exposure light beam 414, which is a laser beam according to a black image signal, is emitted from the LSU 406 onto the photosensitive belt 401 after an elapse of a predetermined period of time since the joint-line sensor 415 has detected the joint line of the photosensitive belt 401 to avoid the joint line of the photosensitive belt 401. The electric charge at a portion irradiated with the exposure light beam 414 is drained, and hence an electrostatic latent image is formed.

Meanwhile, the black developing unit 407 is brought into contact with the photosensitive belt 401 at predetermined timing. The black toner in the black developing unit 407 is negatively charged in advance. The black toner sticks only to the portion (electrostatic-latent-image portion), from which charge is drained by irradiation with the exposure light beam 414, on the photosensitive belt 401. Thus, development by what is called negative/positive process is performed. The black toner image formed on the surface of the photosensitive belt 401 by the black developing unit 407 is transferred onto the intermediate transfer drum 417. Residual toner that is left on the photosensitive belt 401 without being transferred onto the intermediate transfer drum 417 is removed by the photosensitive-element cleaning unit 412. Furthermore, the neutralization device 413 neutralizes the electrical charge on the photosensitive belt 401.

Subsequently, the electrostatic charging unit 405 electrostatically charges the surface of the photosensitive belt 401 uniformly so that a potential reaches approximately −700 V.

Subsequently, the exposure light beam 414, which is a laser beam according to a cyan image signal, is emitted from the LSU 406 onto the photosensitive belt 401 after an elapse of a predetermined period of time since the joint-line sensor 415 has detected the joint line of the photosensitive belt 401 to avoid the joint line of the photosensitive belt 401. Electric charge at a portion irradiated with the exposure light beam 414 is drained, and hence an electrostatic latent image is formed.

Meanwhile, the cyan developing unit 408 is brought into contact with the photosensitive belt 401 at predetermined timing. The cyan toner in the cyan developing unit 408 is negatively charged in advance. The cyan toner sticks only to the portion (electrostatic-latent-image portion), from which charge is drained by irradiation with the exposure light beam 414, on the photosensitive belt 401. Thus, development by what is called negative/positive process is performed. The cyan toner image formed on the surface of the photosensitive belt 401 by the cyan developing unit 408 is transferred onto the intermediate transfer drum 417 to be overlaid on the black toner image. Residual toner that is left on the photosensitive belt 401 without being transferred onto the intermediate transfer drum 417 is removed by the photosensitive-element cleaning unit 412. Furthermore, the neutralization device 413 neutralizes the electrical charge on the photosensitive belt 401.

Subsequently, the electrostatic charging unit 405 electrostatically charges the surface of the photosensitive belt 401 uniformly so that a potential reaches approximately −700 V. Subsequently, the exposure light beam 414, which is a laser beam according to a magenta image signal, is emitted from the LSU 406 onto the photosensitive belt 401 after an elapse of a predetermined period of time since the joint-line sensor 415 has detected the joint line of the photosensitive belt 401 to avoid the joint line of the photosensitive belt 401. Electric charge at a portion irradiated with the exposure light beam 414 is drained, and hence an electrostatic latent image is formed.

Meanwhile, the magenta developing unit 409 is brought into contact with the photosensitive belt 401 at predetermined timing. The magenta toner in the magenta developing unit 409 is negatively charged in advance. The magenta toner sticks only to the portion (electrostatic-latent-image portion), from which charge is drained by irradiation with the exposure light beam 414, on the photosensitive belt 401. Thus, development by what is called negative/positive process is performed. The magenta toner image formed on the surface of the photosensitive belt 401 by the magenta developing unit 409 is transferred onto the intermediate transfer drum 417 to be overlaid on the black toner image and the cyan toner image. Residual toner that is left on the photosensitive belt 401 without being transferred onto the intermediate transfer drum 417 is removed by the photosensitive-element cleaning unit 412. Furthermore, the neutralization device 413 neutralizes the electrical charge on the photosensitive belt 401.

Subsequently, the electrostatic charging unit 405 electrostatically charges the surface of the photosensitive belt 401 uniformly so that a potential reaches approximately −700 V. Subsequently, the exposure light beam 414, which is a laser beam according to a yellow image signal, is emitted from the LSU 406 onto the photosensitive belt 401 after an elapse of a predetermined period of time since the joint-line sensor 415 has detected the joint line of the photosensitive belt 401 to avoid the joint line of the photosensitive belt 401. Electric charge at a portion irradiated with the exposure light beam 414 is drained, and hence an electrostatic latent image is formed.

Meanwhile, the yellow developing unit 410 is brought into contact with the photosensitive belt 401 at predetermined timing. The yellow toner in the yellow developing unit 410 is negatively charged in advance. The yellow toner sticks only to the portion (electrostatic-latent-image portion), from which charge is drained by irradiation with the exposure light beam 414, on the photosensitive belt 401. Thus, development by what is called negative/positive process is performed. The yellow toner image formed on the surface of the photosensitive belt 401 by the yellow developing unit 410 is transferred onto the intermediate transfer drum 417 to be overlaid on the black toner image, the cyan toner image, and the magenta toner image. As a result, a full-color image is formed on the intermediate transfer drum 417. Residual toner that is left on the photosensitive belt 401 without being transferred onto the intermediate transfer drum 417 is removed by the photosensitive-element cleaning unit 412. Furthermore, the neutralization device 413 neutralizes the electrical charge on the photosensitive belt 401.

The transfer unit 423 that has been separated away from the intermediate transfer drum 417 comes into contact with the intermediate transfer drum 417, on which the four color images have been formed, thereby forming a transfer nip. A high voltage of approximately +1 kV is applied from the power supply device (not shown) to the transfer device 425. Thus, secondary transfer of the four color images onto the recording paper 419 conveyed to the transfer device 425 along the conveying path 422 from the recording-paper cassette 420 is performed at once.

A voltage is applied from the power supply device onto the separator 426 to generate an electrostatic force that attracts the recording paper 419, causing the recording paper 419 to be separated from the intermediate transfer drum 417. Subsequently, the recording paper 419 is conveyed to the fixing unit 427, where the full-color image receives pressure by being pinched between the heating roller 428 and the pressing roller 429 and heat from the heating roller 428 to thus be fixed. The recording paper 419 is then delivered onto a discharge tray 431 by discharging rollers 430.

Residual toner that is left on the intermediate transfer drum 417 without being transferred onto the recording paper 419 by the transfer unit 423 is removed by the intermediate-transfer-member cleaning unit 418. The intermediate-transfer-member cleaning unit 418 is at an angular displacement away from the intermediate transfer drum 417 until the full-color image has been formed. After the four color images have been transferred onto the recording paper 419, the intermediate-transfer-member cleaning unit 418 comes into contact with the intermediate transfer drum 417 to remove the residual toner from the intermediate transfer drum 417. By performing the series of operations described above, formation of a sheet of the full-color image is completed.

Also in the printer according to the fourth embodiment, when an impact occurring when the transfer sheet enters the transfer nip causes variation in the surface moving velocity of the intermediate transfer drum 417 to occur, image quality degrades as described in the first embodiment. In view of this, in the fourth embodiment, torque-exertion control that cancels a torque variation of the intermediate transfer drum 417 is performed to reduce the variation in the surface moving velocity of the intermediate transfer drum 417.

Figure 15:
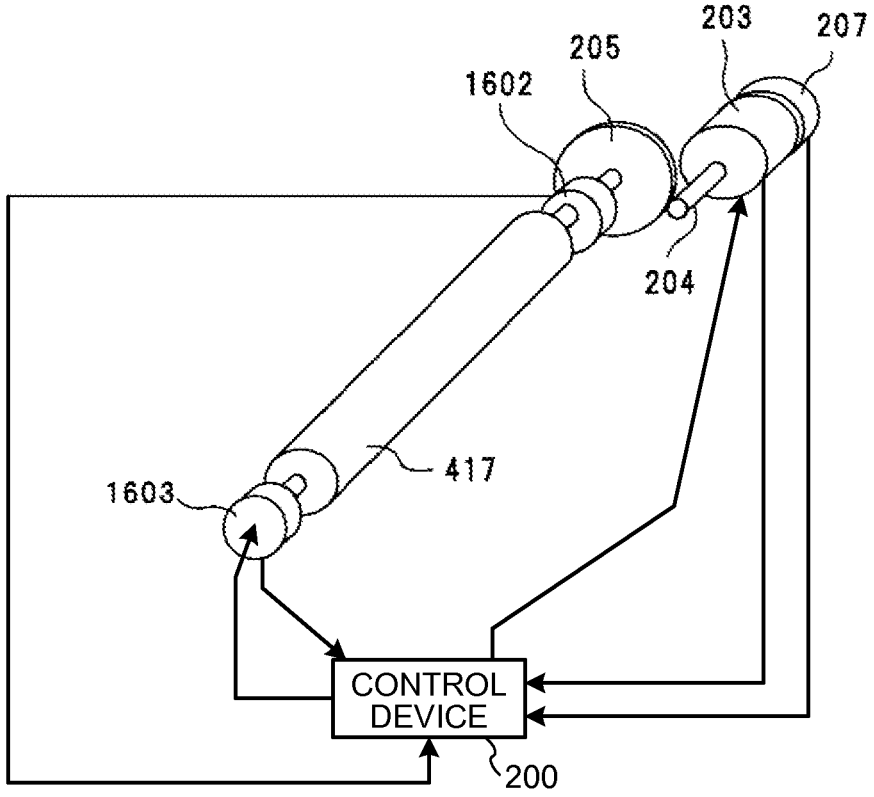
FIG. 15 is an explanatory diagram illustrating a configuration related to driving control of an intermediate transfer drum of the printer according to the fourth embodiment.

FIG. 15 is an explanatory diagram of the configuration related to driving control of the intermediate transfer drum 417 according to the fourth embodiment.

The fourth embodiment is similar to the first embodiment in basic configuration; however, the configuration of the fourth embodiment differs from that of the first embodiment in that a drum-angular-velocity detecting encoder 1602 that detects a drum angular velocity of the intermediate transfer drum 417 is attached to a drive end (an end portion where the DC motor 203 is connected) of a rotary shaft of the intermediate transfer drum 417. An auxiliary motor 1603 is attached with a joint (not shown) having great rigidity to an end portion, on the side opposite to the drive end, of the rotary shaft of the intermediate transfer drum 417. The same motor as the auxiliary motor 209 of the first embodiment can be used as the auxiliary motor 1603.

Figure 16:
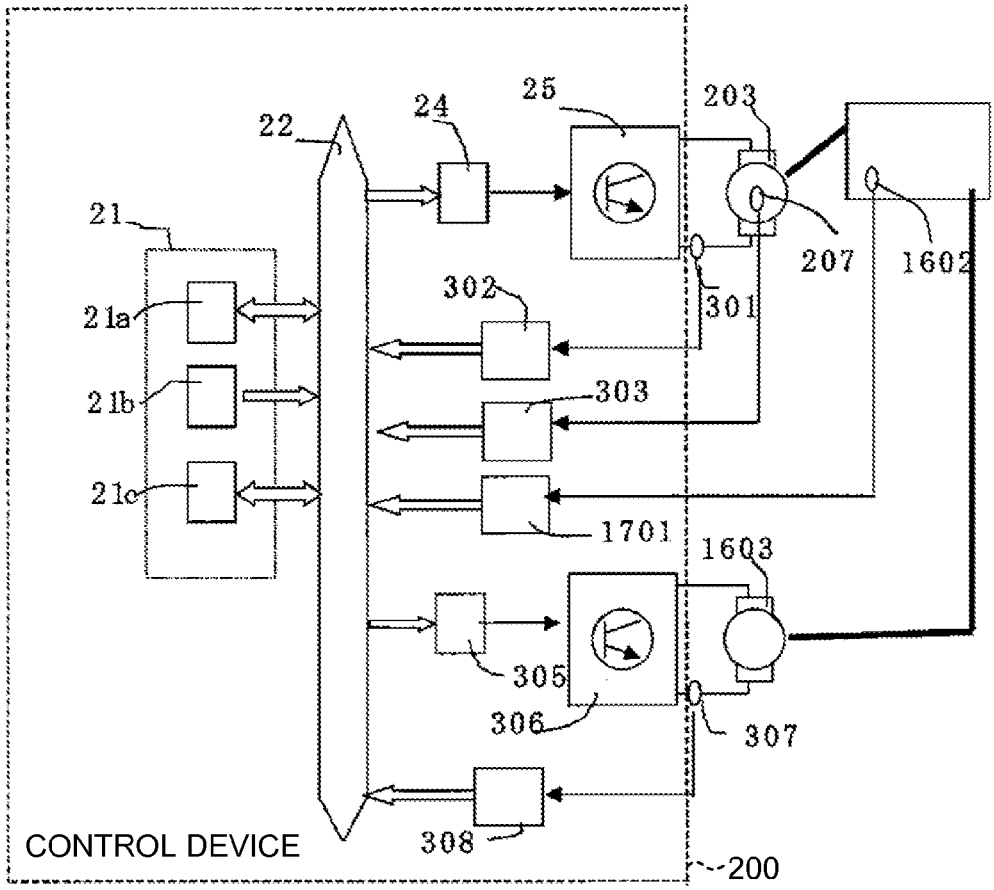
FIG. 16 is a hardware block diagram for explaining a drive control system of the intermediate transfer drum formed by the control device of the printer according to the fourth embodiment.

FIG. 16 is a hardware block diagram for explaining a drive control system of the control device 200 for the intermediate transfer drum 417 according to the fourth embodiment.

In the fourth embodiment, an output of the drum-angular-velocity detecting encoder 1602 is input to a detection interface device 1701 of the control device 200 to be input to the microcomputer 21 as an angular velocity of the intermediate transfer, drum 417. The function of the detection interface device 1701 is similar to that of the driven-roller-angular-velocity detection interface device 304 of the first embodiment. In the fourth embodiment, the microcomputer 21 inputs the determined torque-exertion control amount to the auxiliary-motor drive 306 via the auxiliary-motor-driving interface device 305.

As in the first embodiment, an analytical model of the drive control system for the intermediate transfer drum 417 according to the fourth embodiment can be considered as a model that includes 2-inertia system of the motor portion and the transfer unit portion. Accordingly, a similar effect to that yielded by the first embodiment can be obtained by performing torque-exertion control similar to that performed in the first embodiment.

Fifth Embodiment

Examples in which the present invention is applied to what is called motor constant-speed control have been described as the first to fourth embodiments. However, application of the present invention is not limited to motor constant-speed control, but is possible also to a control system that directly controls a control target. Hence, as an example of such application, a fifth embodiment, in which the intermediate transfer belt 6 is controlled based on an output of the driven-roller-angular-velocity detecting encoder 208 attached to the driven roller 201 of the intermediate transfer belt 6 will be described below.

The basic configuration of the fifth embodiment is similar to that of the first embodiment illustrated in FIGS. 2 to 6 and 8. An overview of a control system, which is a feature of the fifth embodiment, will be described below.

Figure 17:
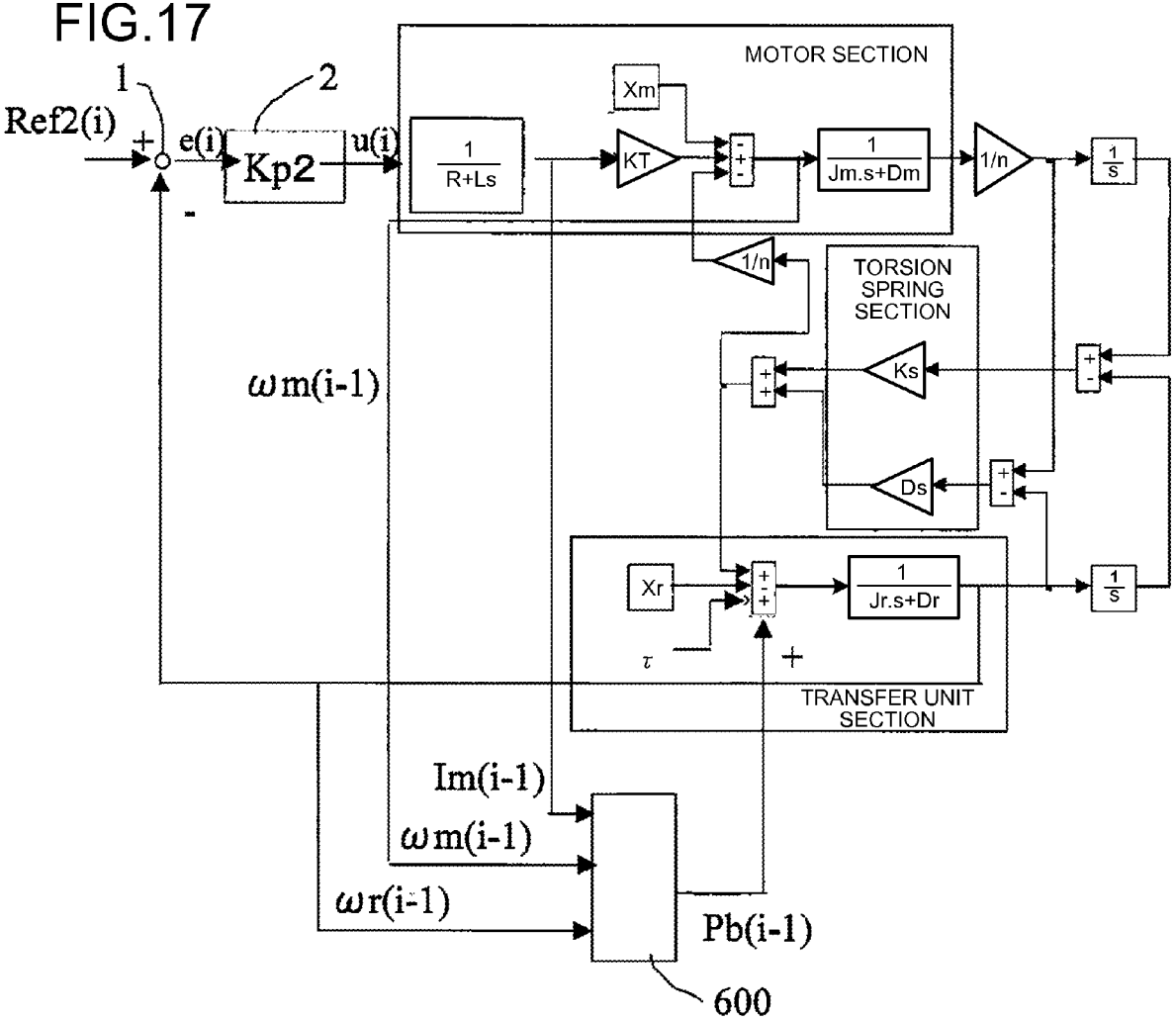
FIG. 17 is an explanatory diagram illustrating an overview of a control system according to a fifth embodiment.

FIG. 17 is a schematic diagram illustrating the overview of the control system, which is the feature of the fifth embodiment.

As illustrated in FIG. 3, the driven-roller-angular-velocity detecting encoder 208 is attached to the rotary shaft of the driven roller 201 that supports the intermediate transfer belt 6, and an output of the driven-roller-angular-velocity detecting encoder 208 is input to the control device 200 (FIG. 4). The driven-roller angular velocity is in linear relation with the velocity of the intermediate transfer belt 6. Accordingly, in general, the velocity of the intermediate transfer belt 6 is controllable by using an output of the driven-roller-angular-velocity detecting encoder 208. This is also utilized in the fifth embodiment. More specifically, the angular velocity $\omega r(i-1)$ output from the motor-angular-velocity detection interface device 304 that processes output pulse signals of the driven-roller-angular-velocity detecting encoder 208 is input to a calculation unit (subtracter) 701. The calculation unit 701 calculates a difference e(i) between a target motor angular velocity Ref2(*i*) and the angular velocity $\omega r(i-1)$ of the driven-roller-angular-velocity detecting encoder 208. The difference e(i) is input to the controller unit 702. A P control system, for instance, can be used as the controller unit 702. A driving voltage u(i) of the DC motor 203 is determined by multiplying e(i) calculated by the calculation unit 701 by a constant of proportionality Kp2. Furthermore, pulsed driving signals are generated by the motor-driving interface device 24 and the motor drive 25 based on the driving voltage u(i). The DC motor 203 is driven by the driving signals.

Meanwhile, in this example, the P control system is used as an example of the controller unit 702; however, the controller unit 702 is not limited thereto. All the calculations described above are performed as numerical calculations by the microcomputer 21 and can be implemented easily. By repeating the operations described above, the intermediate transfer belt is driven at a desired velocity. At this time, as illustrated in FIG. 17, by arranging the torque-exertion-control-amount setting unit 600 as in the case of FIG. 7, the external disturbance $\tau r$ is cancelled in the transfer unit portion; that is, the external disturbance $\tau r$ becomes negligible. Accordingly, the torque variation of the intermediate transfer belt 6 that would otherwise occur when the transfer sheet enters the transfer nip is prevented.

The control to be performed by the control device 200 on the auxiliary motor 209, 1603 is implemented by the microcomputer 21 of the printer by executing program instructions for performing the control. The program instructions may be installed on the ROM 21*b* or the like in the microcomputer 21 via a storage medium, e.g., an optical disk, such as a compact-disk ROM (CD-ROM), or a magnetic disk, such as a flexible disk. Alternatively, the program instructions may be installed on the ROM 21*b* or the like in the microcomputer 21 via a communication network rather than via a storage medium.

Each of the printers according to the first to fifth embodiments is an image formation apparatus that includes the intermediate transfer belt 6 or the intermediate transfer drum 417 (hereinafter, referred to as "intermediate transfer member") serving as the image carrier; the DC motor 203 serving as the driving source that generates a driving force for driving the intermediate transfer member 6, 417; the gear reducer mechanism 204, 205 serving as a drive transmission unit that transmits the driving force generated by the DC motor 203 to the intermediate transfer member 6, 417; the microcomputer 21 and the motor-driving interface device 24 serving as the driving control unit that controls the DC motor 203 to cause the DC motor 203 to run at the target driving angular velocity Ref(i) or to cause the intermediate transfer member 6, 417 to be driven at directly the target driving angular velocity Ref2 (*i*); the photosensitive element 1, 301 serving as an image formation unit that forms an image on the surface of the intermediate transfer member 6, 417, the surface of which is moved by the driving force transmitted from the gear reducer mechanism 204, 205; and the secondary transfer roller 10 or a transfer belt 224 serving as a transfer member that forms the transfer nip between the surface of the intermediate transfer member 6, 417 and the secondary transfer roller 10 or the transfer belt 224. The image formation apparatus transfers the image formed on the surface of the intermediate transfer member 6, 417 onto a transfer sheet serving as the recording medium, thereby forming an image on the transfer sheet. Each of these printers includes the auxiliary motors 209, 1603 serving as the driving-force exerting unit; the motor-driving-current detector 301, the motor-angular-velocity detecting encoder 207 and the driven-roller-angular-velocity detecting encoder 208, or the drum-angular-velocity detecting encoder 1602 serving as the detecting unit; the torque-exertion-control-amount setting unit 600 serving as the torque-change-amount estimation unit; and the microcomputer 21 and the auxiliary-motor-driving interface device 305 serving as a driving-force control unit. The driving-force exerting unit exerts a driving force on any one of the secondary-transfer opposed roller 9 and the intermediate transfer member 417 provided on the drive transmission path from the DC motor 203 to the intermediate transfer belt 6 on the side of the intermediate transfer belt with reference to the gear reducer mechanism 204, 205 serving as the specific drive transmission member that imparts weakest spring characteristics, which are the spring characteristics having greatest effect on the drive transmission system among drive transmission members arranged on the drive transmission path. The detecting unit detects estimation parameters for use in estimating the driving-load-torque change amount (external disturbance) $\tau r$ of the intermediate transfer member 6, 417 that has varied in a predetermined sampling period. The sampling period is set so as to include a time when the transfer sheet enters the transfer nip. The estimation parameters include the driving current Im(i−1) of the DC motor 203, the motor angular velocity $\omega m(i-1)$ of the DC motor 203, and the angular velocity $\omega r(i-1)$ of the driven roller to be rotated by the intermediate transfer member 6, 417. The torque-change-amount estimation unit continually samples the detected estimation parameters Im(i−1), $\omega m(i-1)$, and $\omega r(i-1)$ at a predetermined sampling interval and estimates the driving-load-torque variation amount (external disturbance) $\tau r$ based on the sampled estimation parameters. The driving-force control unit controls the driving force to be exerted by the auxiliary motor 209, 1603 so as to cancel the driving-load-torque variation amount (external disturbance) $\tau t$ estimated by the torque-exertion-control-amount setting unit 600. If the sampling interval is set to a short period of time, which is quite feasible by using today's technique, this configuration makes it possible to cancel the torque variation of the intermediate transfer member 6, 417 that occurs when the transfer sheet enters the transfer nip by performing feedback control in real time (more strictly, with a delay of a sampling unit time) with high accuracy. Accordingly, irrespective of what torque variation profile is to be created from the torque variation of the intermediate transfer member 6, 417 when a transfer sheet enters the transfer nip, the torque variation can be cancelled with high accuracy. Thus, it is possible to cancel the torque variation of the intermediate transfer member 6, 417 that occurs when the transfer sheet enters the transfer nip stably and with high accuracy irrespective of a type of the transfer sheet, a usage environment, and a usage condition, thereby reducing variation in the surface moving velocity of the intermediate transfer member 6, 417.

In the first to fifth embodiments, while the intermediate transfer member 6, 417 is driven, the auxiliary motor 209, 1603 is controlled so as to cancel the driving-load-torque variation amount (external disturbance) $\tau r$ estimated by the torque-exertion-control-amount setting unit 600 all around the intermediate transfer member 6, 417. This makes it possible to cancel not only the torque variation of the intermediate transfer member 6, 417 caused by an impact that occurs when a transfer sheet enters the transfer nip, but also the torque variation of the intermediate transfer member 6, 417 caused by other cause, such as an impact that occurs when a trailing end of the transfer sheet comes out of the transfer nip and an impact that occurs when a member that can come into contact and away from the intermediate transfer member 6, 417 really comes into contact or away from the same.

Furthermore, in a state where no impact is given to the image carrier, it is not necessary to exert a driving force on the image carrier by the auxiliary motor 209, 1603. Accordingly, an increase in power consumption can be suppressed.

In each of the first to fifth embodiments, the configuration in which the driving force to be exerted by the auxiliary motor 209, 1603 is preferably controlled over a period that includes at least the time when a transfer sheet enters the transfer nip. Accordingly, degradation in image quality that would otherwise be caused by an impact that occurs when a transfer sheet enters the transfer nip can be reduced.

In each of the first to third and fifth embodiments, the auxiliary motor 209 preferably exerts a rotative driving force on the secondary-transfer opposed roller 9 or the driving roller 7, which is a rotating member that rotates in conjunction with surface movement of the intermediate transfer belt 6. Also in this case, as long as a configuration where the secondary-transfer opposed roller 9 or the driving roller 7 can be considered to rotate integrally with the surface movement of the intermediate transfer belt 6 is employed, it is possible to cancel the torque variation of the intermediate transfer member 6, 417 with high accuracy, thereby reducing the variation in the surface moving velocity of the intermediate transfer member 6, 417.

In each of the first to fifth embodiments, the auxiliary motor 209, 1603 is preferably controlled according to the control amount Pb(i−1) obtained by converting the driving-load-torque variation amount $\tau r'$ estimated by the external disturbance estimator 601 of the torque-exertion-control-amount setting unit 600 into the control amount Pb(i−1) for the auxiliary motor 209, 1603 by using the adjustment coefficient C1 and the like. This makes it possible to cancel the driving-load-torque variation amount (external disturbance) $\tau r$ of the intermediate transfer member 6, 417 with higher accuracy.

In each of the first to fifth embodiments, as the estimation parameters, the driving current Im(i−1), which is a driving input value to be input to the DC motor 203 to determine the driving angular velocity of the DC motor 203, the motor angular velocity $\omega m(i-1)$, which is the driving angular velocity of the DC motor 203, and the angular velocity $\omega r(i-1)$, which is the surface moving velocity of the intermediate transfer member 6, 417 or an angular velocity of the driven roller 201 used in detecting the same are preferably detected, and the driving-load-torque variation amount (external disturbance) $\tau r$ is preferably estimated by the external disturbance estimator 601 by using the analytical model including the 2-inertia system that is connected with the torsion spring portion including the gear reducer mechanism 204, 205, one inertial system which is on the side of the DC motor 203 with reference to the gear reducer mechanism 204, 205, whereas the other inertial system which is on the side of the intermediate transfer member 6, 417, 205 with reference to the gear reducer mechanism 204, 205. This allows highly-accurate estimation of the driving-load-torque variation amount (external disturbance) $\tau r$.

In a process of producing the present invention, the present inventors have studied a method for canceling torque variation of an image carrier with high accuracy by a control method that differs from conventional methods of canceling torque variation of an image carrier by performing braking control based on a torque variation profile obtained by measurement in advance, and have reached the conclusion described below.

FIG. 1 is a graph of torque variation (thick line) that occurs to an intermediate transfer belt (image carrier) when a recording medium enters a transfer nip of a printer according to an embodiment, which will be described later.

As seen in the graph, a torque of the image carrier shows a short-lived sharp drop (i.e., driving load torque increases) when a leading end of the recording medium enters the transfer nip caused by a momentary increase in load. After the leading end of the recording medium has entered the transfer nip, the torque of the image carrier gradually recovers because the momentarily increased load is released. At this moment, as illustrated in the graph, the torque of the image carrier largely exceeds a normal torque value, and thereafter (i.e., after an overshoot) the torque gradually diminishes to an ordinary torque value.

As a result of the study, the inventors have found that it is not possible to cancel such momentary large torque variation including an overshoot by performing feedback control on the driving source because a drive transmission system from the driving source to the image carrier has spring characteristics.

More specifically, a member (a specific drive transmission member), such as a gear and/or a timing belt, that imparts spring characteristics to the drive transmission system is generally provided on a drive transmission path from the driving source to the image carrier. When a specific drive transmission member such as those above lies on the drive transmission path, a delay increases in a response in feedback control that is performed on the driving source. This makes it difficult to cancel a torque variation that lasts for a brief period of time, such as a torque variation that occurs when a recording medium enters the transfer nip, by performing the feedback control on the driving source.

This will be described using a specific example in which, for example, feedback control is performed on the driving source based on drive information (in this example, information about an angular velocity for a rotation of an output shaft of the driving source) at a location upstream of the specific drive transmission member in the drive transmission path (on the side of the driving source). In this case, a torque variation of the image carrier that occurs when a recording medium enters the transfer nip is transmitted to the output shaft of the driving source via the specific drive transmission member. Accordingly, the torque variation is converted into a variation in the angular velocity of the output shaft of the driving source and input back to driving control of the driving source. Thus, because of the presence of the specific drive transmission member that imparts spring characteristics, the torque variation of the image carrier that occurs when the recording medium enters the transfer nip is transmitted to the output shaft of the driving source after a delay that depends on the spring characteristics. If a configuration in which a torque variation of the image carrier that occurs when a recording medium enters the transfer nip is transmitted directly to the output shaft of the driving source rather than via a specific drive transmission member, a delay in the response in the feedback control performed on the driving source includes only a delay corresponding to a sampling unit time (sampling interval) of the feedback control. In contrast, when the torque variation is transmitted via the specific drive transmission member, a delay in the response in the feedback control performed on the driving source includes not only the delay corresponding to the sampling unit time but also a delay, a length of which depends on the spring characteristics.

As another example, let us consider a case in which feedback control is performed on the driving source based on drive information (in this example, information about an angular velocity of surface movement of the image carrier) at a location on the drive transmission path downstream of the specific drive transmission member in a drive transmission path. In this case, a torque variation of the image carrier when a recording medium enters the transfer nip is fed back without passing through the specific drive transmission member. However, also in this case, the specific drive transmission member that imparts spring characteristics is provided on the drive transmission path along which feedback-controlled driving of the driving source is transmitted to the image carrier. Accordingly, although the torque variation of the image carrier that occurs when a recording medium enters the transfer nip can be fed back immediately to the driving source only with a delay corresponding to the sampling unit time, a delay, length of which depends on the spring characteristics, is produced in a period until the feedback-controlled driving is transmitted to the image carrier.

As described above, in addition to the delay corresponding to the sampling unit time, a delay, length of which depends on the spring characteristics that is to be imparted by the specific drive transmission member, is produced in the feedback control insofar as a target of the feedback control of torque variation of the image carrier that occurs when a recording medium enters the transfer nip is the driving source of the image carrier, irrespective of a location on the drive transmission path to be chosen to obtain the driving information that is used in performing the feedback control on the driving source. The torque variation that occurs when the recording medium enters the transfer nip cannot be cancelled because time length of the delay in the response is too large compared to a time length of the torque variation that occurs when the recording medium enters the transfer nip.

The inventors have carried out extensive studies based on the result of the research described above and found that if a target of feedback control of a torque variation of the image carrier that occurs when a recording medium enters the transfer nip is a driving-force exerting unit that exerts a driving force on the image carrier at a location upstream of the specific drive transmission member that imparts spring characteristics in the drive transmission path, even when a delay in the response corresponding to the sampling unit time (sampling interval) is produced, the torque variation can be cancelled with high accuracy. A feedback loop of such feedback control performed on the driving force to be exerted by the driving-force exerting unit based on actually-occurred torque variation of the image carrier does not include spring characteristics of the specific drive transmission member. Accordingly, in this feedback control, a delay in the response caused by the spring characteristics will not be produced. Even in this case, a delay in the response corresponding to the sampling unit time (sampling interval) is produced. However, by using a modern technique, it is quite feasible to set the sampling interval short relative to a time length of a torque variation that occurs when a recording medium enters the transfer nip. It is confirmed that this feedback control can cancel the torque variation with high accuracy.

Furthermore, such feedback control that is performed with a short sampling interval and hence close to real-time control can cancel not only a torque variation of the image carrier caused by an impact applied to the image carrier when a recording medium enters the transfer nip but also a torque variation caused by an impact whose occurrence is unpredictable or, even when the occurrence is predictable, it is difficult to predict the occurrence with high accuracy, or an impact that makes a torque variation profile of the image carrier inconstant.

Furthermore, if, rather than a method of reducing or removing a driving load torque applied to the image carrier in advance, a method of causing a driving-torque applying unit to exert a driving torque on the image carrier is employed as a method for canceling a large driving load torque applied to the image carrier while the torque varies, the need of applying a driving load torque to the image carrier in advance is eliminated. Accordingly, the latter method requires less power than the former method.

According to an aspect of the present invention, a driving-force exerting unit that exerts a driving force on a drive transmission member or an image carrier provided on a drive transmission path in a downstream (on a side of an image carrier) of a specific drive transmission member. Feedback control of the driving-force exerting unit is performed based on an actually-occurred torque variation on the image carrier. Accordingly, by setting a sampling interval to a short period of time, which is quite feasible by using a modern technique, a torque variation on the image carrier caused by an impact that occurs in a sampling period can be cancelled with high accuracy. In particular, by setting the sampling period so as to include a time when a recording medium enters a transfer nip, a torque variation on the image carrier caused by an impact when the recording medium enters the transfer nip can be cancelled with high accuracy irrespective of a type of the recording medium, a usage environment, or a usage condition.

Furthermore, an increase in power consumption can be suppressed because it is not necessary to apply a driving load torque on the image carrier in advance.

It should be noted that a torque variation on the image carrier is a parameter that cannot be detected directly. In view of this, according to the aspect of the present invention, estimation parameters for use in estimating a driving-load-torque variation amount of the image carrier are detected, and the driving-load-torque variation amount is estimated based on the estimation parameters. This estimation can be implemented by utilizing a known external disturbance estimator or the like.

As described above, according to an aspect of the present invention, even a torque variation of an image carrier, which has been difficult to cancel by using a conventional control method, caused by an impact whose occurrence is unpredictable or, even when the occurrence is predictable, it is difficult to predict the occurrence with high accuracy, or caused by an impact that makes a torque variation profile inconstant can be cancelled while suppressing an increase in power consumption.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image formation apparatus for forming an image on a recording medium, the image formation apparatus comprising:

an image carrier having an angular velocity;

a driving source configured to generate a driving force based on a driving current provided thereto, the driving force for driving the image carrier;

a drive transmission unit configured to transmit, via a driving roller having an angular velocity, the driving force generated by the driving source to the image carrier;

a driving control unit configured to control the driving source to cause the image carrier to be driven at any one of a target driving angular velocity and a target velocity;

an image formation unit configured to form an image on a surface of the image carrier, the surface being moved by the driving force transmitted from the drive transmission unit;

a transfer member configured to form, between the transfer member and the surface of the image carrier, a transfer nip, which the recording medium enters to transfer the image formed on the surface of the image carrier onto the recording medium;

a driving-force exerting unit configured to exert, via a driven roller which is a different roller from the driving roller, an additional driving force on any one of the image carrier and a first drive transmission member among drive transmission members provided on a drive transmission path ranging from the driving source to the image carrier, the additional driving force configured to selectively vary between a driving torque provided in a same direction as the driving force provided by the driving source and a load torque provided in a opposite direction as the driving force provided by the driving source, the first drive transmission member being on a side of the image carrier with reference to a specific drive transmission member, and the specific drive transmission member imparting weakest spring characteristics among the drive transmission members to a drive transmission system formed by the drive transmission members;

a detecting unit configured to detect estimation parameters used in estimating a driving-load-torque variation amount of the image carrier, the estimation parameters including at least (i) the driving current of the driving source, (ii) an angular velocity of the driving source and (iii) the angular velocity of the driving roller;

a torque-variation-amount estimation unit configured to sample the estimation parameters detected by the detecting unit continually at a predetermined sampling interval and estimate the driving-load-torque variation amount based on the sampled estimation parameters; and a driving-force control unit configured to control the additional driving force such that the additional driving force exerted by the driven roller cancels the driving-load-torque variation amount estimated by the torque-variation-amount estimation unit by applying the additional driving force, if the driving-load-torque variation amount indicates a variation in the angular velocity of the image carrier, the applied additional driving force being the driving torque if the angular velocity of the image carrier has decreased and the applied additional driving force being the load torque if the angular velocity of the image carrier has increased.

2. The image formation apparatus according to claim 1, wherein the additional driving force to be exerted by the driving-force exerting unit is controlled during a period that includes at least a time when the recording medium enters the transfer nip.

3. The image formation apparatus according to claim 1, wherein the driving-force exerting unit is configured to exert a rotative driving force on a rotating member that rotates in conjunction with surface movement of the image carrier.

4. The image formation apparatus according to claim 1, wherein the driving-force control unit is configured to convert the driving-load-torque variation amount estimated by the torque-variation-amount estimation unit into a control amount for the driving-force exerting unit and control the driving-force exerting unit according to the control amount.

5. The image formation apparatus according to claim 1, wherein the detecting unit is configured to detect, as the estimation parameter, a driving input value that is to be input to the driving source to determine a driving angular velocity of the driving source and any one of a position, a velocity, and an angular velocity of the surface movement of the image carrier, and the torque-variation-amount estimation unit includes an external disturbance estimator configured to estimate the driving-load-torque variation amount by using an analytical model of a 2-inertia system including a first portion formed by a side of the driving source with reference to the specific drive transmission member, a second portion formed by a side of the image carrier with reference to the specific drive transmission member, and a torsion spring portion, formed by the specific drive transmission member, that connects the first portion and the second portion.

6. The image formation apparatus according to claim 1, wherein the driving source includes a first motor, and the driving-force exerting unit includes a second motor.

7. The image formation apparatus according to claim 1, wherein the detecting unit further comprises:

a first encoder configured to detect a first estimation parameter, the first encoder connected to the driving source; and a second encoder configured to detect a second estimation parameter, the second encoder connected to one of the drive transmission members.

8. The image formation apparatus according to claim 1, wherein the drive transmission unit is configured to transmit the driving force generated by the driving source to a driving roller.

9. A driving control method for an image carrier of an image formation apparatus that forms an image on a recording medium, the image formation apparatus including, a driving source configured to generate a driving force based on a driving current provided thereto, the driving force for driving the image carrier;

a drive transmission unit configured to transmit, via a driving roller having an angular velocity, the driving force generated by the driving source to the image carrier;

a driving control unit configured to control a driving angular velocity of the driving source so that one of the driving source and the image carrier is driven at any one of a target driving angular velocity and a target velocity;

an image formation unit configured to form an image on a surface of the image carrier, the surface being moved by the driving force transmitted from the drive transmission unit;

a transfer member configured to form, between the transfer member and the surface of the image carrier, a transfer nip, which the recording medium enters to transfer the image formed on the surface of the image carrier onto the recording medium; and a driving-force exerting unit configured to exert, via a driven roller which is a different roller from the driving roller, an additional driving force on any one of the image carrier and a first drive transmission member among drive transmission members provided on a drive transmission path ranging from the driving source to the image carrier, the additional driving force configured to selectively vary between a driving torque provided in a same direction as the driving force provided by the driving source and a load torque provided in a opposite direction as the driving force provided by the driving source, the first drive transmission member being on a side of the image carrier with reference to a specific drive transmission member, and the specific drive transmission member imparting weakest spring characteristics among the drive transmission members to a drive transmission system formed by the drive transmission members, the driving control method comprising:

detecting estimation parameters for use in estimating a driving-load-torque variation amount of the image carrier, the estimation parameters including at least (i) the driving current of the driving source, (ii) an angular velocity of the driving source and (iii) the angular velocity of the driving roller;

sampling the estimation parameters continually at a predetermined sampling interval;

estimating the driving-load-torque variation amount based on the sampled estimation parameters; and exerting the additional driving force, via the driven roller, on any one of the image carrier and the first drive transmission member such that the additional driving force exerted by the driven roller cancels the estimated driving-load-torque variation amount by applying the additional driving force, if the driving-load-torque variation amount indicates a variation in the angular velocity of the image carrier, the applied additional driving force being the driving torque if the angular velocity of the image carrier has decreased and the applied additional driving force being the load torque if the angular velocity of the image carrier has increased.

10. A computer program product comprising a non-transitory computer-usable medium having a computer-readable program code embodied in the medium causing a computer to instruct an image formation apparatus that includes:

an image carrier having an angular velocity;

a driving source configured to generate a driving force based on a driving current provided thereto, the driving force for driving the image carrier;

a drive transmission unit configured to transmit, via a driving roller having an angular velocity, the driving force generated by the driving source to the image carrier;

a driving control unit configured to control a driving angular velocity of the driving source so that one of the driving source and the image carrier is driven at any one of a target driving angular velocity and a target velocity;

an image formation unit configured to form an image on a surface of the image carrier, the surface being moved by the driving force transmitted from the drive transmission unit;

a transfer member configured to form, between the transfer member and the surface of the image carrier, a transfer nip, which a recording medium enters to transfer the image formed on the surface of the image carrier onto the recording medium; and a driving-force exerting unit configured to exert, via a driven roller which is a different roller from the driving roller, a driving force on any one of the image carrier and a first drive transmission member among drive transmission members provided on a drive transmission path ranging from the driving source to the image carrier, the additional driving force configured to selectively vary between a driving torque provided in a same direction as the driving force provided by the driving source and a load torque provided in a opposite direction as the driving force provided by the driving source, the first drive transmission member being on a side of the image carrier with reference to a specific drive transmission member, and the specific drive transmission member imparting weakest spring characteristics among the drive transmission members to a drive transmission system of drive transmission members to function as:

a torque-variation-amount estimation unit configured to, sample estimation parameters for use in estimating a driving-load-torque variation amount of the image carrier, the estimation parameters including at least (i) the driving current of the driving source, (ii) an angular velocity of the driving source and (iii) the angular velocity of the driving roller, and estimate the driving-load-torque variation amount based on the sampled estimation parameters; and a driving-force control unit configured to control the additional driving force exerted by the driving-force exerting unit such that the additional driving force cancels the driving-load-torque variation amount estimated by the torque-variation-amount estimation unit by applying the additional driving force, if the driving-load-torque variation amount indicates a variation in the angular velocity of the image carrier, the applied additional driving force being the driving torque if the angular velocity of the image carrier has decreased and the applied additional driving force being the load torque if the angular velocity of the image carrier has increased.

* * * * *